US011918869B2

(12) United States Patent
Parsons et al.

(10) Patent No.: US 11,918,869 B2
(45) Date of Patent: Mar. 5, 2024

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Matthew T. Andrews, Scottsdale, AZ (US); Bradley D. Schweigert, Cave Creek, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 18/241,633

(22) Filed: Sep. 1, 2023

(65) Prior Publication Data

US 2023/0405422 A1 Dec. 21, 2023

Related U.S. Application Data

(63) Continuation-in-part of application No. 18/219,215, filed on Jul. 7, 2023, which is a continuation-in-part of application No. 18/102,534, filed on Jan. 27, 2023, and a continuation-in-part of application No. 18/099,461, filed on Jan. 20, 2023, and a (Continued)

(51) Int. Cl.

| | |
|---|---|
| ***A63B 53/04*** | (2015.01) |
| ***A63B 53/06*** | (2015.01) |
| ***A63B 60/02*** | (2015.01) |

(52) U.S. Cl.

CPC ..... *A63B 53/0487* (2013.01); *A63B 53/065* (2013.01); *A63B 60/02* (2015.10); *A63B 53/0408* (2020.08); *A63B 53/0437* (2020.08); *A63B 53/0441* (2020.08); *A63B 53/0466* (2013.01); *A63B 53/047* (2013.01); *A63B 2053/0491* (2013.01)

(58) Field of Classification Search

CPC ... A63B 53/0487; A63B 53/065; A63B 60/02; A63B 53/0408; A63B 53/0437; A63B 53/0441; A63B 53/0466; A63B 53/047; A63B 2053/0491

See application file for complete search history.

(56) References Cited

U.S. PATENT DOCUMENTS

| | | | |
|---|---|---|---|
| 807,224 | A | 12/1905 | Vaile |
| 922,444 | A | 5/1909 | Youds |

(Continued)

FOREIGN PATENT DOCUMENTS

| | | | |
|---|---|---|---|
| FR | 2834647 | A1 | 7/2003 |
| JP | H09271542 | A | 10/1997 |

(Continued)

*Primary Examiner* — Michael D Dennis

(57) ABSTRACT

Embodiments of golf club heads and methods to manufacture golf club heads are generally described herein. In one example, a golf club head may include a body portion having a face portion for striking a golf ball and an enclosed interior cavity. A filler material may be disposed in the interior cavity and may reinforce the face portion. The filler material may include a low-density polymer material to enable discretionary mass placement to other areas of the golf club head. The golf club head may also include a hosel portion configured to adjust certain mass properties of the golf club head. Other examples and embodiments may be described and claimed.

20 Claims, 20 Drawing Sheets

Related U.S. Application Data continuation-in-part of application No. 17/978,877, filed on Nov. 1, 2022, and a continuation-in-part of application No. 17/972,710, filed on Oct. 25, 2022, and a continuation-in-part of application No. 17/824,074, filed on May 25, 2022, and a continuation-in-part of application No. 17/709,746, filed on Mar. 31, 2022, and a continuation-in-part of application No. 17/706,782, filed on Mar. 29, 2022, now Pat. No. 11,745,068, and a continuation-in-part of application No. 17/472,321, filed on Sep. 10, 2021, said application No. 18/099,461 is a continuation of application No. 17/378,252, filed on Jul. 16, 2021, now Pat. No. 11,583,738, said application No. 17/972,710 is a continuation of application No. 17/344,705, filed on Jun. 10, 2021, now Pat. No. 11,511,169, said application No. 17/378,252 is a continuation-in-part of application No. 17/232,401, filed on Apr. 16, 2021, now Pat. No. 11,090,535, said application No. 17/978,877 is a continuation of application No. 17/133,260, filed on Dec. 23, 2020, now Pat. No. 11,517,798, said application No. 17/824,074 is a continuation-in-part of application No. 17/123,325, filed on Dec. 16, 2020, now Pat. No. 11,369,849, said application No. 17/472,321 is a continuation-in-part of application No. 16/940,806, filed on Jul. 28, 2020, now Pat. No. 11,141,635, said application No. 17/344,705 is a continuation of application No. 16/751,500, filed on Jan. 24, 2020, now Pat. No. 11,045,698, said application No. 17/706,782 is a continuation of application No. 16/674,332, filed on Nov. 5, 2019, now Pat. No. 11,311,781, said application No. 17/232,401 is a continuation-in-part of application No. 16/567,937, filed on Sep. 11, 2019, now Pat. No. 10,981,038, said application No. 16/674,332 is a continuation of application No. 16/275,883, filed on Feb. 14, 2019, now Pat. No. 10,493,331, said application No. 16/751,500 is a continuation-in-part of application No. 16/035,271, filed on Jul. 13, 2018, now Pat. No. 10,576,339, said application No. 16/940,806 is a continuation of application No. 16/006,055, filed on Jun. 12, 2018, now Pat. No. 10,737,153.

(60) Provisional application No. 63/525,847, filed on Jul. 10, 2023, provisional application No. 63/524,452, filed on Jun. 30, 2023, provisional application No. 63/470,711, filed on Jun. 2, 2023, provisional application No. 63/402,587, filed on Aug. 31, 2022, provisional application No. 63/390,206, filed on Jul. 18, 2022, provisional application No. 63/244,283, filed on Sep. 15, 2021, provisional application No. 63/008,654, filed on Apr. 10, 2020, provisional application No. 62/949,064, filed on Dec. 17, 2019, provisional application No. 62/798,277, filed on Jan. 29, 2019, provisional application No. 62/755,241, filed on Nov. 2, 2018, provisional application No. 62/745,194, filed on Oct. 12, 2018, provisional application No. 62/659,060, filed on Apr. 17, 2018, provisional application No. 62/644,233, filed on Mar. 16, 2018, provisional application No. 62/533,481, filed on Jul. 17, 2017.

(56) References Cited

U.S. PATENT DOCUMENTS

| | | | | |
|---|---|---|---|---|
| RE19,178 | E | 5/1934 | Spiker | |
| 3,497,220 | A | 2/1970 | Scott | |
| 3,749,408 | A | 7/1973 | Mills | |
| 4,043,562 | A | 8/1977 | Shillington | |
| 4,163,554 | A | 8/1979 | Bernhardt | |
| 4,265,451 | A | 5/1981 | Bernhardt | |
| 4,340,230 | A | 7/1982 | Churchward | |
| 4,754,977 | A | 7/1988 | Sahm | |
| 4,869,507 | A | 9/1989 | Sahm | |
| 4,927,144 | A | 5/1990 | Stormon | |
| 5,116,047 | A | 5/1992 | Phelan et al. | |
| 5,127,653 | A | 7/1992 | Nelson | |
| 5,137,275 | A | 8/1992 | Nelson | |
| 5,193,806 | A | 3/1993 | Burkly | |
| D335,317 | S | 5/1993 | Shearer | |
| D335,692 | S | 5/1993 | Antonious | |
| D336,757 | S | 6/1993 | Antonious | |
| 5,228,332 | A * | 7/1993 | Bernhardt | A63B 53/007 73/65.03 |
| 5,244,205 | A | 9/1993 | Melanson et al. | |
| 5,275,412 | A | 1/1994 | Innes | |
| D350,582 | S | 9/1994 | Miansian et al. | |
| 5,388,827 | A | 2/1995 | Reynolds | |
| 5,390,918 | A | 2/1995 | Meyers et al. | |
| 5,429,366 | A | 7/1995 | McCabe | |
| D363,101 | S | 10/1995 | Sturm | |
| 5,454,563 | A | 10/1995 | Nagamoto et al. | |
| 5,470,063 | A | 11/1995 | Fisher | |
| D365,864 | S | 1/1996 | Sturm | |
| 5,489,097 | A | 2/1996 | Simmons | |
| D368,751 | S | 4/1996 | Rife | |
| D369,393 | S | 4/1996 | Takahashi et al. | |
| 5,518,235 | A | 5/1996 | Mendenhall | |
| 5,569,098 | A | 10/1996 | Klein | |
| 5,571,053 | A | 11/1996 | Lane | |
| D378,688 | S | 4/1997 | Cameron | |
| 5,647,807 | A | 7/1997 | Nagamoto | |
| D385,609 | S | 10/1997 | Cameron | |
| 5,683,307 | A | 11/1997 | Rife | |
| 5,688,190 | A | 11/1997 | Rowland et al. | |
| D388,143 | S | 12/1997 | Huan-Chiang | |
| D389,207 | S | 1/1998 | Cameron | |
| 5,711,719 | A | 1/1998 | Fireman | |
| 5,720,671 | A | 2/1998 | Cheng | |
| 5,749,793 | A | 5/1998 | Lucetti | |
| D398,685 | S | 9/1998 | Masuda | |
| 5,803,824 | A | 9/1998 | Rollingson | |
| D399,290 | S | 10/1998 | Sizemore, Jr. | |
| D399,911 | S | 10/1998 | Nicolette et al. | |
| 5,839,974 | A | 11/1998 | McAllister | |
| 5,842,935 | A | 12/1998 | Nelson | |
| D405,836 | S | 2/1999 | Nicolette et al. | |
| 5,890,969 | A | 4/1999 | Bechler | |
| D409,701 | S | 5/1999 | Ashcraft et al. | |
| 5,924,938 | A | 7/1999 | Hines | |
| 5,941,781 | A | 8/1999 | Sessions | |
| 6,007,434 | A | 12/1999 | Baker et al. | |
| 6,039,656 | A | 3/2000 | Fireman | |
| D422,655 | S | 4/2000 | Hicks | |
| 6,050,903 | A | 4/2000 | Lake | |
| D426,276 | S | 6/2000 | Besnard et al. | |
| 6,083,113 | A | 7/2000 | Bernhardt | |
| D431,854 | S | 10/2000 | Cameron | |
| D432,192 | S | 10/2000 | Hicks | |
| D436,151 | S | 1/2001 | Nicolette et al. | |
| D437,374 | S | 2/2001 | Cameron | |
| 6,217,460 | B1 | 4/2001 | Broadbridge et al. | |
| D441,820 | S | 5/2001 | Nicolette et al. | |
| 6,234,915 | B1 | 5/2001 | Wu | |
| D443,668 | S | 6/2001 | Nicolette et al. | |
| D443,905 | S | 6/2001 | Nicolette et al. | |
| D444,833 | S | 7/2001 | Wells et al. | |
| 6,264,571 | B1 | 7/2001 | Lekavich | |
| 6,277,033 | B1 | 8/2001 | Krumme et al. | |
| D449,664 | S | 10/2001 | Beebe et al. | |

(56) References Cited

U.S. PATENT DOCUMENTS

D449,865 S 10/2001 Fife, Jr. et al.
D450,799 S 11/2001 Nicolette et al.
D451,973 S 12/2001 Wells et al.
6,348,014 B1 2/2002 Chiu
6,354,959 B1 3/2002 Nicolette et al.
6,394,910 B1 5/2002 McCarthy
6,478,694 B2 11/2002 Anderson et al.
D472,949 S 4/2003 Serrano
D474,821 S 5/2003 Wells et al.
D474,949 S 5/2003 Schaffeld et al.
6,561,919 B2 5/2003 Edel
D483,086 S 12/2003 Schweigert et al.
6,659,883 B2 12/2003 Nelson et al.
D486,872 S 2/2004 Schweigert et al.
D488,200 S 4/2004 Olsavsky et al.
D498,276 S 11/2004 Schweigert et al.
6,902,496 B2 6/2005 Solheim et al.
6,902,498 B2 6/2005 Sullivan et al.
D512,116 S 11/2005 Miraflor et al.
6,988,956 B2 1/2006 Cover et al.
6,997,819 B2 2/2006 Naylor et al.
D520,088 S 5/2006 Parr
7,077,760 B2 7/2006 Gray
D531,242 S 10/2006 Adams
D532,067 S 11/2006 Soracco et al.
7,153,220 B2 12/2006 Lo
D534,595 S 1/2007 Hasebe
7,156,752 B1 1/2007 Bennett
7,163,465 B2 1/2007 Edel
D536,401 S 2/2007 Kawami
D536,403 S 2/2007 Kawami
D538,371 S 3/2007 Kawami
7,201,668 B1 4/2007 Pamias
7,204,765 B2 4/2007 Cover et al.
D542,869 S 5/2007 Adams
D543,598 S 5/2007 Kuan et al.
D543,601 S 5/2007 Kawami
7,278,926 B2 10/2007 Frame
D555,219 S 11/2007 Lin
D556,277 S 11/2007 Broom
7,309,297 B1 12/2007 Solari
D561,854 S 2/2008 Morris
7,331,876 B2 2/2008 Klein
7,351,162 B2 4/2008 Soracco et al.
D569,461 S 5/2008 Morris
D569,930 S 5/2008 Nehrbas
7,396,289 B2 7/2008 Soracco et al.
7,407,445 B2 8/2008 Pedraza et al.
7,416,494 B2 8/2008 Edel
D577,085 S 9/2008 Nicolette et al.
D577,086 S 9/2008 Nicolette et al.
D579,506 S 10/2008 Nicolette et al.
D579,995 S 11/2008 Nicolette et al.
D582,497 S 12/2008 Rollinson
7,473,189 B2 1/2009 Schweigert et al.
7,491,131 B2 2/2009 Vinton
D595,793 S 7/2009 Rollinson
D599,425 S 9/2009 Laub
D600,763 S 9/2009 Cameron
7,722,476 B2 5/2010 Pedraza et al.
7,744,485 B2 6/2010 Jones et al.
D620,993 S 8/2010 Laub
D621,461 S 8/2010 Serrano et al.
D623,709 S 9/2010 Serrano et al.
7,857,710 B2 12/2010 Pedraza
D631,925 S 2/2011 Broom
7,887,432 B2 2/2011 Jones et al.
7,909,707 B2 3/2011 Klein
7,918,745 B2 4/2011 Morris et al.
D638,891 S 5/2011 Nicolette et al.
D642,643 S 8/2011 Nicolette et al.
D643,485 S 8/2011 Nicolette et al.
D645,104 S 9/2011 Nicolette et al.
8,016,693 B2 9/2011 Pedraza
8,096,039 B2 1/2012 Soracco et al.
D653,718 S 2/2012 Stokke et al.
8,109,841 B2 2/2012 Miyamichi
D661,753 S 6/2012 Cameron et al.
D666,260 S 8/2012 Cynn
8,371,958 B2 2/2013 Treadwell
8,376,878 B2 2/2013 Bennett et al.
D688,339 S 8/2013 Hilton et al.
D688,341 S 8/2013 Rollinson
D691,226 S 10/2013 Hilton et al.
8,636,607 B2 1/2014 Renna
D699,308 S 2/2014 Rollinson
8,696,492 B1 4/2014 Hocknell et al.
D704,782 S 5/2014 Rollinson
8,721,472 B2 5/2014 Kuan et al.
8,790,193 B2 7/2014 Serrano et al.
D711,483 S 8/2014 Wong
D715,388 S 10/2014 Serrano et al.
8,870,674 B1 10/2014 Abbott
D722,350 S 2/2015 Schweigert
D722,351 S 2/2015 Parsons et al.
D722,352 S 2/2015 Nicolette et al.
D723,120 S 2/2015 Nicolette
D724,164 S 3/2015 Schweigert et al.
D725,208 S 3/2015 Schweigert
D726,265 S 4/2015 Nicolette
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
9,079,077 B2 7/2015 Wolf
9,108,088 B2 8/2015 Serrano et al.
9,108,092 B1 8/2015 Warner
D738,447 S 9/2015 Schweigert
D738,449 S 9/2015 Schweigert
D739,487 S 9/2015 Schweigert
D741,426 S 10/2015 Schweigert
D748,213 S 1/2016 Parsons et al.
D748,215 S 1/2016 Parsons et al.
9,233,283 B2 1/2016 Schweigert
9,272,193 B1 3/2016 Yim
D753,252 S 4/2016 Schweigert
9,375,615 B2 6/2016 Park
9,387,375 B2 7/2016 Schweigert
9,440,124 B2 9/2016 Parsons et al.
9,545,544 B2 1/2017 Jones et al.
9,604,108 B1 3/2017 Dunnell et al.
9,649,540 B2 5/2017 Parsons et al.
9,675,854 B2 6/2017 Wang et al.
9,795,844 B1 * 10/2017 Dacey ..... A63B 53/0487
9,808,680 B1 11/2017 Myers et al.
9,895,585 B2 2/2018 Kroloff
9,925,427 B2 3/2018 Bischmann et al.
9,956,463 B2 5/2018 Franklin et al.
9,987,530 B2 6/2018 Jertson et al.
10,166,445 B2 1/2019 Brandt
10,478,680 B2 11/2019 Schweigert et al.
10,493,331 B2 12/2019 Kroloff et al.
10,576,339 B2 3/2020 Schweigert et al.
10,632,352 B2 4/2020 Lambeth et al.
10,668,340 B2 6/2020 Ambeth et al.
10,737,153 B2 8/2020 Schweigert et al.
10,821,341 B2 11/2020 Schweigert et al.
10,960,271 B2 3/2021 Kroloff et al.
10,981,038 B2 4/2021 Schweigert et al.
11,045,698 B2 6/2021 Schweigert et al.
11,090,535 B1 8/2021 Schweigert et al.
11,141,635 B2 10/2021 Schweigert et al.
11,161,021 B2 11/2021 Becktor et al.
11,298,597 B2 4/2022 Parsons et al.
11,364,422 B1 6/2022 Parsons et al.
11,369,849 B2 6/2022 Andrews et al.
11,420,100 B2 8/2022 Wang et al.
11,517,798 B2 12/2022 Kroloff et al.
2002/0077193 A1 6/2002 Takeda
2002/0151376 A1 10/2002 Verne
2002/0193174 A1 12/2002 Edel
2003/0045372 A1 3/2003 Vrska
2003/0199332 A1 10/2003 Lindsay

(56) References Cited

U.S. PATENT DOCUMENTS

| | | | | |
|---|---|---|---|---|
| 2004/0014532 | A1 | 1/2004 | Lee et al. | |
| 2004/0138003 | A1 | 7/2004 | Grace | |
| 2004/0180730 | A1 | 9/2004 | Franklin et al. | |
| 2006/0052178 | A1 | 3/2006 | Franklin et al. | |
| 2006/0094522 | A1 | 5/2006 | Tang et al. | |
| 2006/0223649 | A1 | 10/2006 | Rife | |
| 2007/0129163 | A1 | 6/2007 | Solari | |
| 2007/0135232 | A1 | 6/2007 | Billings | |
| 2007/0142122 | A1 | 6/2007 | Bonneau | |
| 2007/0207875 | A1 | 9/2007 | Kuan et al. | |
| 2007/0238548 | A1 | 10/2007 | Johnson | |
| 2008/0139333 | A1 | 6/2008 | Klein | |
| 2008/0146372 | A1 | 6/2008 | John | |
| 2008/0176672 | A1 | 7/2008 | Roach et al. | |
| 2009/0029800 | A1 | 1/2009 | Jones et al. | |
| 2009/0156328 | A1 | 6/2009 | Reese | |
| 2009/0163287 | A1 | 6/2009 | Vald'Via et al. | |
| 2009/0239678 | A1 | 9/2009 | Cruz et al. | |
| 2010/0035700 | A1 | 2/2010 | Yu et al. | |
| 2010/0255922 | A1 | 10/2010 | Lueders | |
| 2010/0317454 | A1 | 12/2010 | Sato et al. | |
| 2011/0165959 | A1 | 7/2011 | Klein | |
| 2013/0005499 | A1* | 1/2013 | Cameron | A63B 69/3685 473/314 |
| 2013/0165256 | A1 | 6/2013 | Stevenson | |
| 2013/0210537 | A1 | 8/2013 | Ainscough et al. | |
| 2014/0100053 | A1* | 4/2014 | Stokke | A63B 60/00 473/292 |
| 2015/0306477 | A1 | 10/2015 | Parsons et al. | |
| 2016/0016050 | A1 | 1/2016 | Rife | |
| 2016/0136487 | A1 | 5/2016 | Clarke et al. | |
| 2016/0346649 | A1 | 12/2016 | Jertson et al. | |
| 2018/0001163 | A1 | 1/2018 | Becktor et al. | |
| 2018/0311545 | A1 | 11/2018 | Lambeth et al. | |
| 2018/0361206 | A1 | 12/2018 | Becktor et al. | |
| 2021/0146205 | A1 | 5/2021 | Parsons et al. | |
| 2021/0245019 | A1 | 8/2021 | Schweigert et al. | |
| 2021/0299527 | A1* | 9/2021 | Schweigert | A63B 53/10 |
| 2022/0152464 | A1* | 5/2022 | Pedraza | A63B 53/007 |
| 2023/0364479 | A1* | 11/2023 | Serrano | A63B 53/0408 |

FOREIGN PATENT DOCUMENTS

| | | | |
|---|---|---|---|
| JP | 11253590 | A | 9/1999 |
| JP | 2004223184 | A | 8/2004 |
| JP | 2005065796 | A | 3/2005 |
| JP | 2005160691 | A | 6/2005 |
| JP | 2013043091 | A | 3/2013 |
| KR | 200377377 | Y1 | 3/2005 |
| KR | 200403045 | Y1 | 12/2005 |
| KR | 20100065481 | A | 6/2010 |
| KR | 101773069 | B1 | 8/2017 |
| WO | 03020372 | A2 | 3/2003 |
| WO | 2006087846 | A1 | 8/2006 |
| WO | 2006113966 | A1 | 11/2006 |
| WO | 2008074093 | A1 | 6/2008 |
| WO | 2011043708 | A1 | 4/2011 |
| WO | 2012036991 | A1 | 3/2012 |
| WO | 2014145547 | A2 | 9/2014 |
| WO | 2015005593 | A1 | 1/2015 |

* cited by examiner

GOLF CLUB HEADS AND METHODS TO MANUFACTURE GOLF CLUB HEADS

CROSS REFERENCE

This application claims the benefit of U.S. Provisional Application No. 63/525,847, filed Jul. 10, 2023.

This application is a continuation-in-part of application Ser. No. 18/219,215, filed Jul. 7, 2023, which claims the benefit of U.S. Provisional Application No. 63/524,452, filed Jun. 30, 2023, and the benefit of U.S. Provisional Application No. 63/470,711, filed Jun. 2, 2023.

U.S. application Ser. No. 18/219,215 is a continuation-in-part of application Ser. No. 17/472,321, filed Sep. 10, 2021, which is a continuation of application Ser. No. 16/940,806, filed Jul. 28, 2020, now U.S. Pat. No. 11,141,635, which is a continuation of U.S. application Ser. No. 16/006,055, filed Jun. 12, 2018, now U.S. Pat. No. 10,737,153, which claims the benefit of U.S. Provisional Application No. 62/644,233, filed Mar. 16, 2018, and U.S. Provisional Application No. 62/659,060, filed Apr. 17, 2018.

U.S. application Ser. No. 18/219,215 is a continuation-in-part of application Ser. No. 17/706,782, filed Mar. 29, 2022, now U.S. Pat. No. 11,745,068, which is a continuation of application Ser. No. 16/674,332, filed Nov. 5, 2019, now U.S. Pat. No. 11,311,781, which is a continuation of application Ser. No. 16/275,883, filed Feb. 14, 2019, now U.S. Pat. No. 10,493,331, which claims the benefit of U.S. Provisional Application No. 62/745,194, filed Oct. 12, 2018, and U.S. Provisional Application No. 62/755,241, filed Nov. 2, 2018.

U.S. application Ser. No. 18/219,215 is a continuation-in-part of application Ser. No. 17/972,710, filed Oct. 25, 2022, which is a continuation of application Ser. No. 17/344,705, filed Jun. 10, 2021, now U.S. Pat. No. 11,511,169, which is a continuation of application Ser. No. 16/751,500, filed Jan. 24, 2020, now U.S. Pat. No. 11,045,698, which claims the benefit of U.S. Provisional Application No. 62/798,277, filed Jan. 29, 2019.

U.S. application Ser. No. 16/751,500 is a continuation-in-part of application Ser. No. 16/035,271, filed Jul. 13, 2018, now U.S. Pat. No. 10,576,339, which claims the benefit of U.S. Provisional Application No. 62/533,481, filed Jul. 17, 2017.

U.S. application Ser. No. 18/219,215 is a continuation-in-part of application Ser. No. 18/099,461, filed Jan. 20, 2023, which is a continuation of application Ser. No. 17/378,252, filed Jul. 16, 2021, now U.S. Pat. No. 11,583,738, which is a continuation of application Ser. No. 17/232,401, filed Apr. 16, 2021, now U.S. Pat. No. 11,090,535, which is a continuation of application Ser. No. 16/567,937, filed Sep. 11, 2019, now U.S. Pat. No. 10,981,038.

U.S. application Ser. No. 18/219,215 is a continuation-in-part of application Ser. No. 17/824,074, filed May 25, 2022, which is a continuation of application Ser. No. 17/123,325, filed Dec. 16, 2020, now U.S. Pat. No. 11,369,849, which claims the benefit of U.S. Provisional Application No. 62/949,064, filed Dec. 17, 2019.

U.S. application Ser. No. 18/219,215 is a continuation-in-part of application Ser. No. 17/978,877, filed Nov. 1, 2022, which is a continuation of application Ser. No. 17/133,260, filed Dec. 23, 2020, now U.S. Pat. No. 11,517,798, which claims the benefit of U.S. Provisional Application No. 63/008,654, filed Apr. 10, 2020.

U.S. application Ser. No. 18/219,215 is a continuation-in-part of application Ser. No. 17/709,746, filed Mar. 31, 2022, which claims the benefit of U.S. Provisional Application No. 63/244,283, filed Sep. 15, 2021.

U.S. application Ser. No. 18/219,215 is a continuation-in-part of application Ser. No. 18/102,534, filed Jan. 27, 2023, which claims the benefit of U.S. Provisional Application No. 63/402,587, filed Aug. 31, 2022, and claims the benefit of U.S. Provisional Application No. 63/390,206, filed Jul. 18, 2022.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials may be used to manufacture golf club heads. By using multiple materials to manufacture golf club heads, certain mass properties of a golf club head may be optimized to improve performance.

Figure 1:
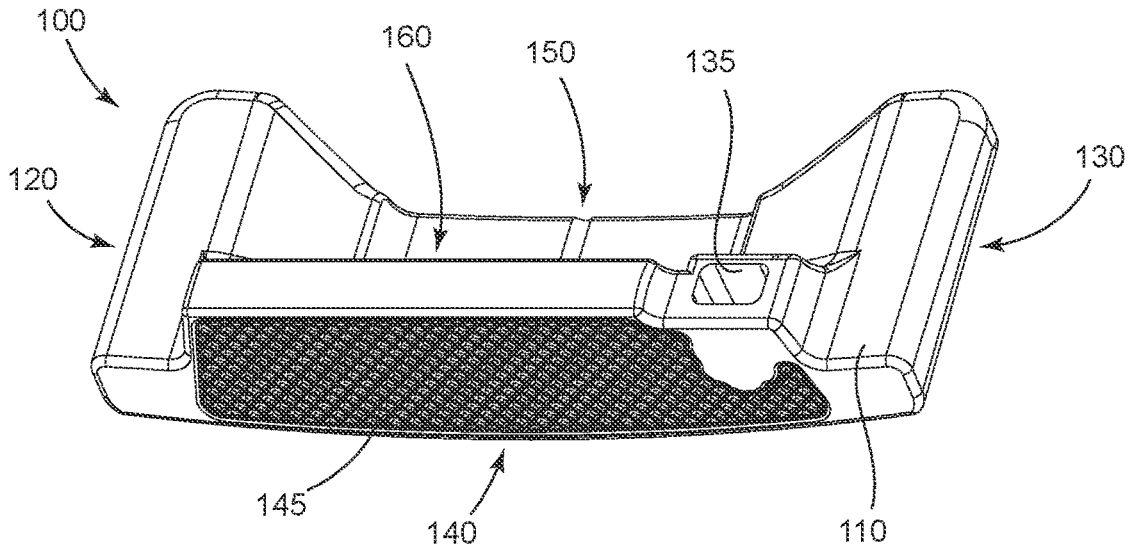
FIGS. 1, 2, 3, 4, 5, 6, 7, 8, and 9 depict a perspective front view, an exploded bottom perspective view, a front elevational view, a rear elevational view, an exploded rear perspective view, a perspective cross-sectional view (along line 6-6 of FIG. 4), a perspective cross-sectional view (along line 7-7 of FIG. 4), a perspective cross-sectional view (along line 8-8 of FIG. 4), and a perspective cross-sectional view (along line 9-9 of FIG. 4), respectively, of a golf club head according to an embodiment of the apparatus, methods, and articles of manufacture described herein.
Figure 2:
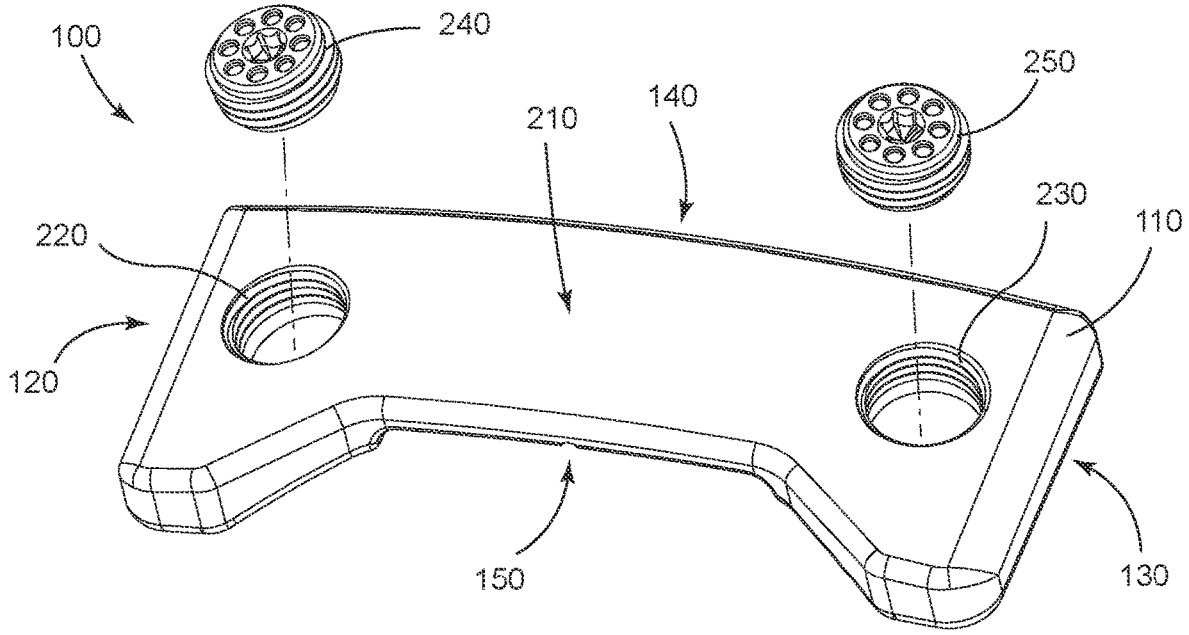
Figure 3:
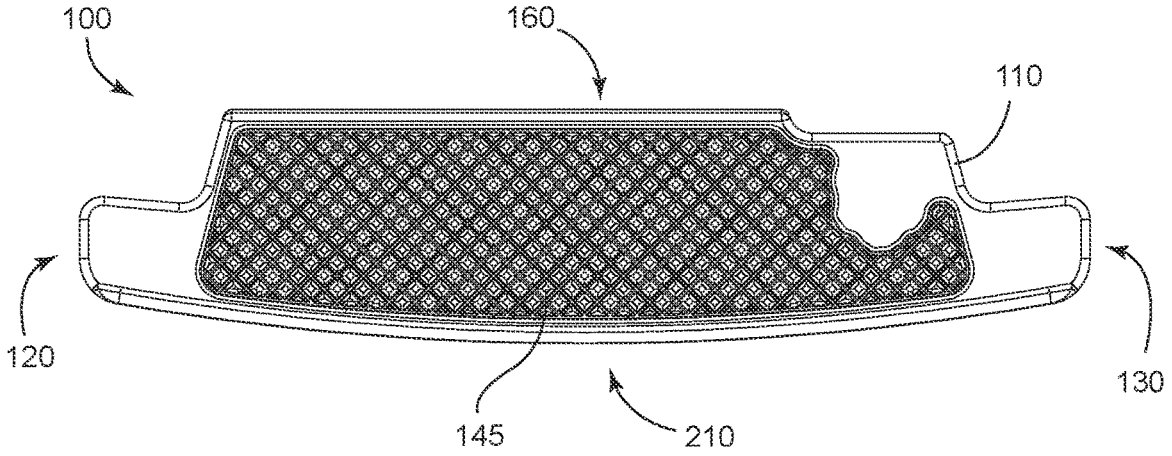
Figure 4:
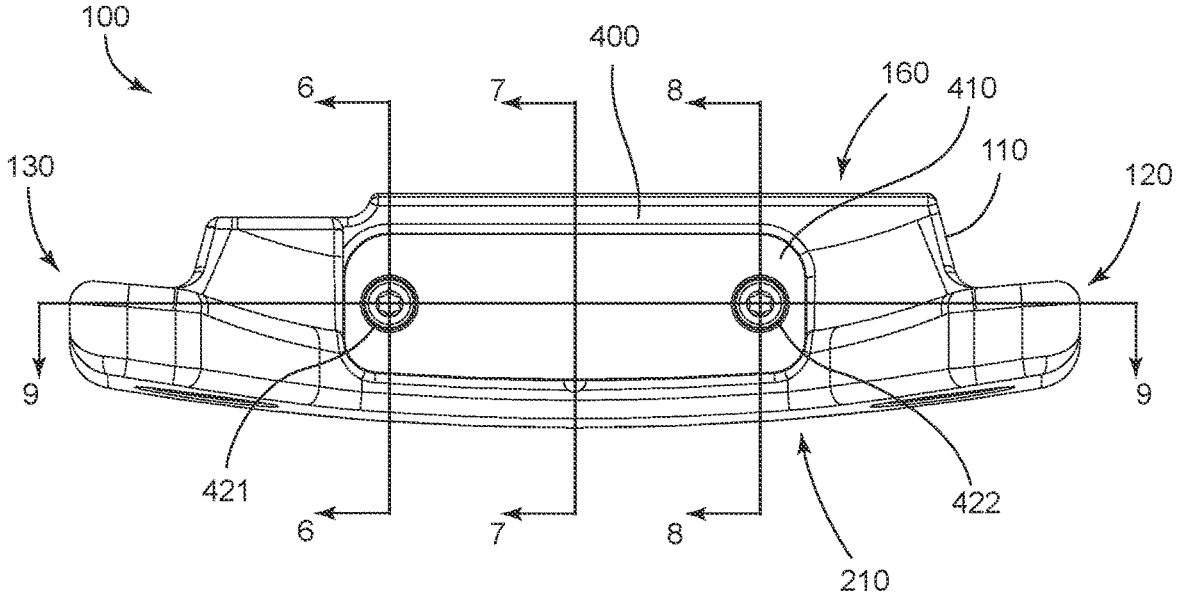
Figure 5:
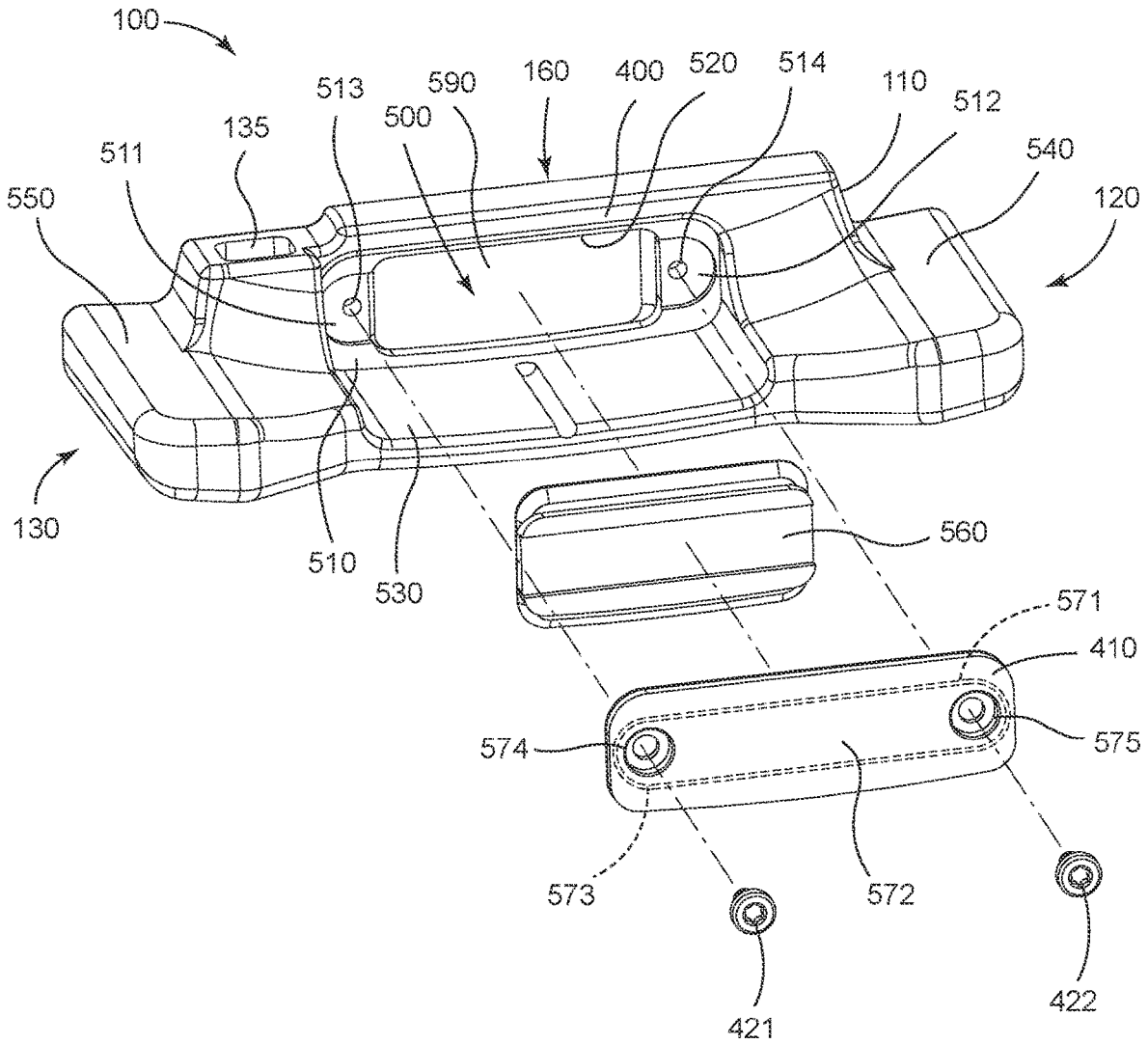
Figure 6:
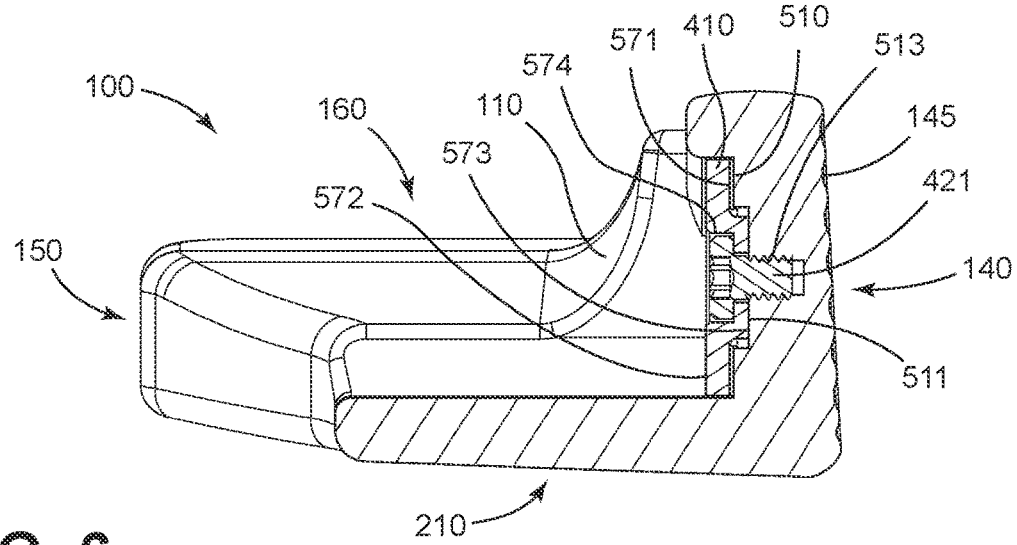

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. patents and patent applications, which are collectively referred to herein as "the incorporated by reference patent documents," are incorporated by reference herein in their entirety: U.S. Pat. Nos. 9,233,283; 9,387,375; 9,440,124; 9,649,540; 9,895,585; 10,478,680; 10,493,331; 10,576,339; 10,737,153; 10,821,341; 10,960,271; 10,981,038; 11,045,698; 11,298,597; 11,369,849; and 11,517,798; and U.S. Patent Publication Nos. 20180200589 and 20220219054.

In general, golf club heads and methods to manufacture golf club heads are described herein. The apparatus, methods, and articles of manufacture described herein are not limited in this regard.

In the example of FIGS. 1-9, a golf club head 100 is generally shown as a first type of blade putter. The golf club head 100 may include a body portion 110 made from any of the materials described herein or described in any of the incorporated by reference patent documents. The body portion 110 may have a toe portion 120, a heel portion 130 opposite the toe portion 120, a hosel bore 135 located at the heel portion 130, a front portion 140, a face portion 145 located at the front portion 140, a rear portion 150 opposite the front portion 140, a top portion 160, and a sole portion 210 opposite the top portion 160. The body portion 110 may be manufactured via various manufacturing methods and/or processes (e.g., a casting process, a forging process, a milling process, a cutting process, a grinding process, a welding process, a combination thereof, etc.). The body portion 110 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 110 may be partially or entirely made of a non-metal material (e.g., composite, plastic, etc.). The apparatus, methods, and articles of manufacture described herein are not limited in this regard.

The face portion 145 may define a front surface of the body portion 110 for striking a golf ball. The face portion 145 may be generally planar and may have a loft angle greater than or equal to two degrees and less than or equal to four degrees. The sole portion 210 may include a plurality of weight ports (e.g., shown as a toe-side weight port 220 and a heel-side weight port 230) each configured to receive a complementary weight portion (e.g., shown as weight portions 240 and 250). Weight portions 240 and 250 may be configured as interchangeable screws threadedly coupled to the toe-side weight port 220 and the heel-side weight port 230, respectively. Weight portions 240 and 250 may be made from any of the materials described herein and may have similar or different material compositions and/or physical properties (e.g., density, color, texture) with respect to each other and the body portion 110. The hosel bore 135 may be configured to receive a variety of hosel types to accommodate a variety of swing types. The configuration and/or properties of each of the weight ports and the weight portions may be similar in many respects to any of the weight ports and weight portions, respectively, described in any of the incorporated by reference patent documents. The apparatus, methods, and articles of manufacture described herein are not limited in this regard.

The golf club head 100 may include an interior cavity 500 within the body portion 110. The interior cavity 500 may be located between the face portion 145 and a back wall portion 400 disposed opposite the face portion 145. The back wall portion 400 may extend between the toe portion 120 and the heel portion 130 and may include a recessed portion 510 defining an opening 520 that interfaces with the interior cavity 500. The recessed portion 510 may be located adjacent a ledge portion 530 at or proximate the rear portion 150 and extending between a toe-side mass platform 540 and a heel-side mass platform 550. In the example of FIGS. 1-9, the ledge portion 530 may be recessed relative to the toe-side mass platform 540 and the heel-side mass platform 550. The interior cavity 500 may be partially or entirely filled with a filler material 560. The filler material 560 may be any type of polymer material described herein or described in any of the incorporated by reference patent documents. In one example, the filler material 560 may include a low-density polymer material. In another example, the filler material 560 may be a solid piece manufactured in the shape of the interior cavity 500 so as to be insertable into the interior cavity 500 through the opening 520. In yet another example, the filler material 560 may be an injectable liquid or fluid material provided to the interior cavity 500 via the opening 520 and later hardened at ambient conditions or during a curing process. The golf club head 100 may include a cover portion shown for example as back plate 410 that may be coupled to the body portion 110 to close the opening 520 and to enclose the interior cavity 500. The apparatus, methods, and articles of manufacture described herein are not limited in this regard.

The back plate 410 may have a complementary shape to the recessed portion 510. The back plate 410 may include a front surface 571, a rear surface 572, and a stiffening member 573. In one example, as illustrated in FIGS. 1-9, the stiffening member 573 may be configured as an elongated rib or protrusion extending longitudinally across the front surface 571 of the back plate 410. The back plate 410 may be joined to the body portion 110 such that the front surface 571 of the back plate 410 contacts the recessed portion 510 and the end portions of the stiffening member 573 are each received in a complementary indent (e.g., shown as indents 511 and 512) in the recessed portion 510. In the present example, the stiffening member 573 may extend across the opening 520 in a toe-to-heel direction of the golf club head 100. Indents 511 and 512 may each include a fastener port (e.g., shown as fastener ports 513 and 514) concentrically aligned with a complementary through-port (e.g., shown as through-ports 574 and 575) extending through the rear surface 572 and the stiffening member 573 of the back plate 410. The back plate 410 may be attached to the body portion 110 via a first mechanical fastener 421 inserted in through-port 574 and threadedly engaged to fastener port 513 and a second mechanical fastener 422 inserted in through-port 575 and threadedly engaged to fastener port 514. In another example, only an adhesive may be used to join the front surface 571 of the back plate 410 to the recessed portion 510. In yet another example, fasteners and one or more adhesives may be used to join the front surface 571 of the back plate 410 to the recessed portion 510. In operation, the stiffening member 573 may impart structural rigidity to the back plate 410 and may also compress the filler material 560 against a rear surface 590 of the face portion 145. The back plate 410 may be made from any of the materials described herein or described in any of the incorporated by reference patent documents. The apparatus, methods, and articles of manufacture described herein are not limited in this regard.

The filler material 560 may contact and reinforce the rear surface 590 of the face portion 145 to reduce face deformation and also dampen sound and vibration. The filler material 560 may also encase a portion of the stiffening member 573 extending across the opening 520 to help maintain the back plate 410 in place. The rear surface 590 of the face portion 145 may include a rear surface of a central strike portion 700 of the face portion 145. The central strike portion 700 may correspond to a portion of the face portion 145 bisected by a center longitudinal plane 900 of the golf club head 100 and may extend a length 910 between the toe portion 120 and the heel portion 130. In one example, the length 910 of the central strike portion 700 may be greater than or equal to 1.00 inch (25.4 mm) and less than or equal to 1.70 inch (43.18 mm). In another example, the length 910 of the central strike portion 700 may be greater than or equal to 1.20 inches (30.48 mm) and less than or equal to 1.70 inch (43.18 mm). In yet another example, the length 910 of the central strike portion 700 may be greater than or equal to 1.40 inches (35.56 mm) and less than or equal to 1.70 inch (43.18 mm). The apparatus, methods, and articles of manufacture described herein are not limited in this regard.

Figure 7:
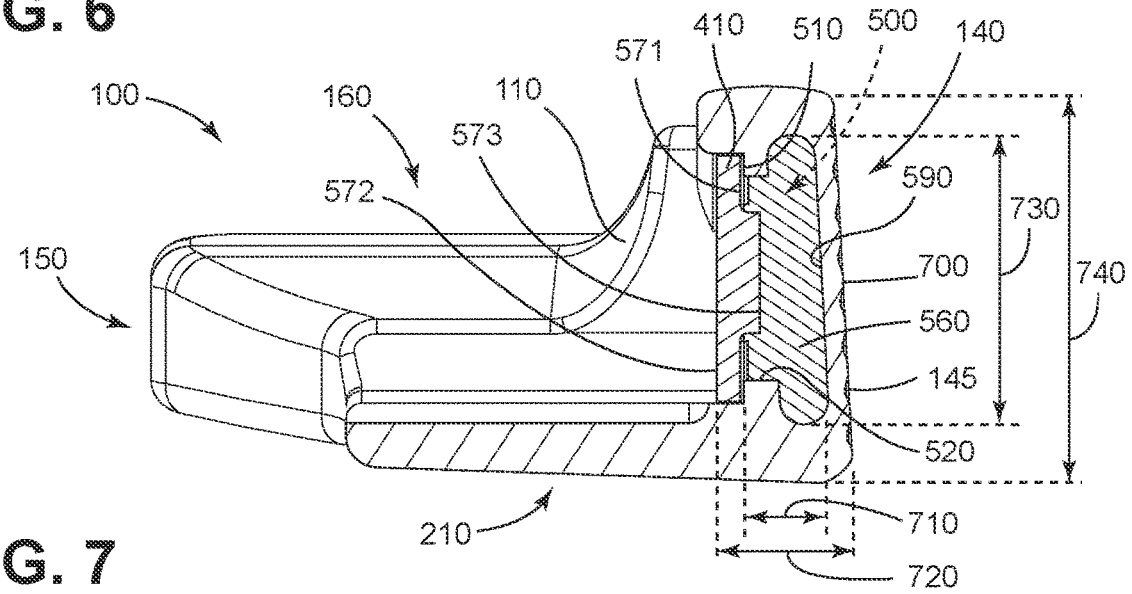
Figure 8:
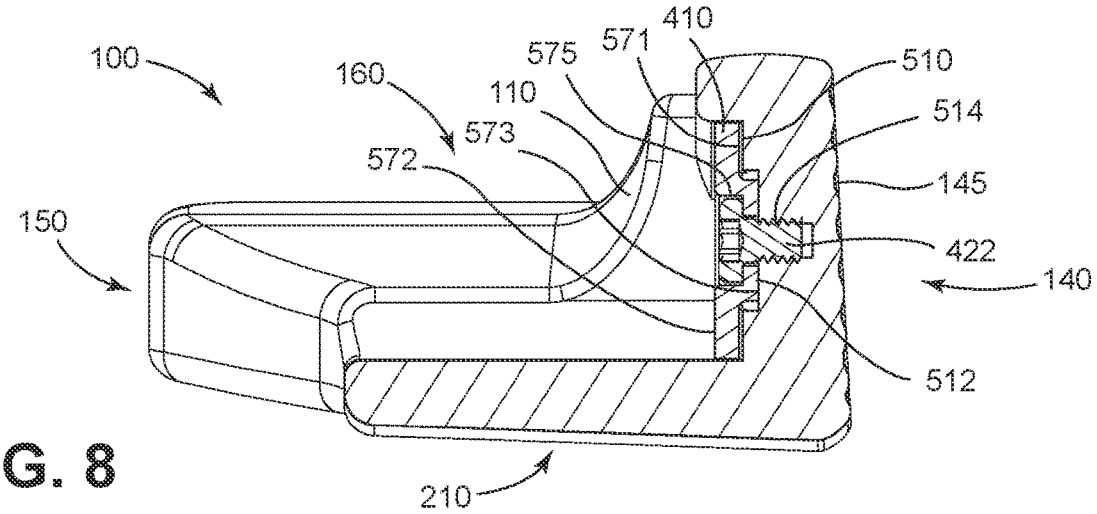
Figure 9:
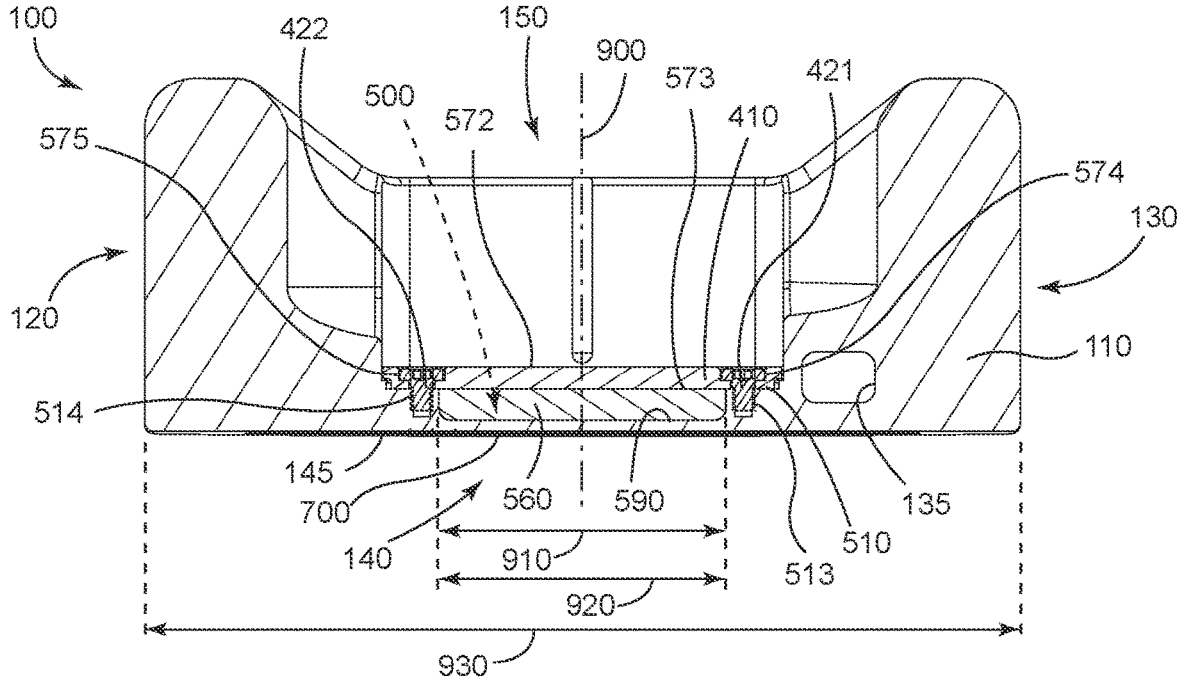

In one example, as illustrated in FIG. 7, the golf club head 100 may have at least one cross-section where the filler material 560 has a length 710 in a front-to-rear direction greater than or equal to 40% of a length 720 between the front surface of the face portion 145 and the rear surface 572 of the back plate 410. With continued reference to FIG. 7, the golf club head 100 may have at least one cross-section where the filler material 560 has a length 730 in a top-to-sole direction greater than or equal to 70% of a length 740 of the body portion 110 in the top-to-sole direction. With reference to FIG. 9, the golf club head 100 may have at least one cross-section where the filler material 560 has a length 920 in a toe-to-heel direction greater than or equal to the length 910 of the central strike portion 700 and/or greater than or equal to 30% of a length 930 of the body portion 110 in the toe-to-heel direction. The apparatus, methods, and articles of manufacture described herein are not limited in this regard.

The filler material 560 may have a density less than a density of the body portion 110 so that more discretionary mass may be allocated to other areas of the golf club head 100. With respect to the present example, the filler material 560 may have a fill volume ($V_f$) greater than or equal to 6% and less than or equal to 10% of a total volume ($V_t$) of the golf club head 100 and a fill mass ($M_f$) greater than or equal to 0.5% and less than or equal to 1% of a total mass ($M_t$) of the golf club head 100. In one example, the total volume ($V_t$) of the golf club head 100 may be greater than or equal to 2.50 inch$^3$ (40.968 cm$^3$) and less than or equal to 3.00 inch$^3$ (49.161 cm$^3$) and the total mass ($V_t$) of the golf club head 100 may be greater than or equal to 300 grams and less than or equal to 345 grams Selecting the filler material 560 from a lightweight or low-density material and increasing the fill volume ($V_f$) of the filler material 560 relative to the total volume ($V_t$) of the golf club head 100 may enable greater discretionary mass placement toward a periphery of the golf club head 100 to optimize certain mass properties of the golf club head 100 such as moment of inertia (MOI), center of gravity (CG) location, and mass balance while maintaining a suitable club head weight. With respect to any of the examples described herein, a periphery of a golf club head may include the perimeter portions of the toe portion, the heel portion, and the rear portion, respectively. As defined herein, a ratio between a percentage fill volume $$\left(\frac{Vf}{Vt} \times 100\right)$$

and a percentage fill mass $$\left(\frac{Mf}{Mt} \times 100\right)$$

of a tiller material may be indicative of the level of freedom in which discretionary mass may be distributed to other areas of a golf club head. Said differently, the ratio between a percentage fill volume and a percentage fill mass of a filler material may correspond to the percentage fill volume divided by the percentage fill mass and a larger ratio value may signify a greater degree of freedom in discretionary mass placement. In one example, the filler material 560 may have a ratio between a percentage fill volume and a percentage fill mass of a filler material that may be greater than or equal to 6.00 and the golf club head 100 may have a MOI greater than or equal to 4500 g·cm$^2$. In another example, the golf club head 100 may have a MOI greater than or equal to 4700 g·cm$^2$. In yet another example, the golf club head 100 may have a MOI greater than or equal to 5000 g·cm$^2$. The apparatus, methods, and articles of manufacture described herein are not limited in this regard.

Figure 10:
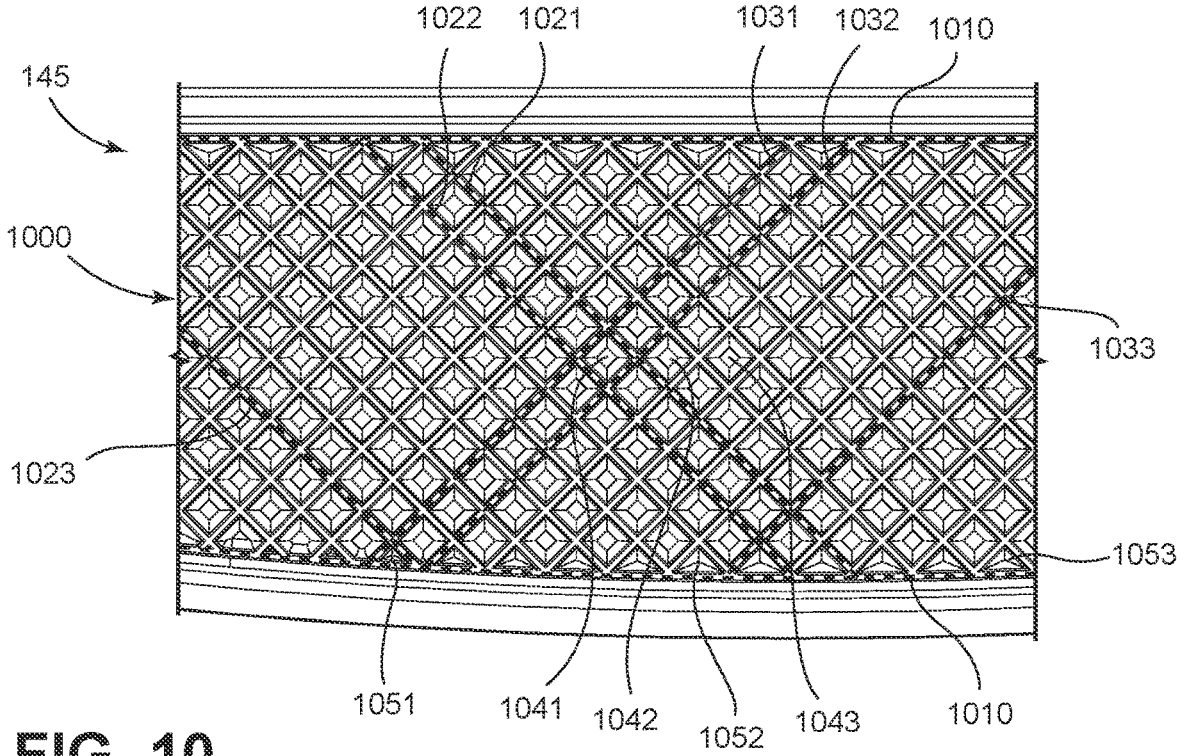
FIG. 10 depicts an enlarged schematic front view of a face portion of the golf club head of FIGS. 1-9 according to an embodiment of the apparatus, methods, and articles of manufacture described herein.

The golf club head 100 may have thin cavity walls to provide additional discretionary mass to be allocated to other areas of the golf club head 100 compared to conventional solid-body golf club heads. For example, one or more cavity walls may have a thickness (constant or average) greater than or equal to 0.035 inch (0.889 mm) and less than or equal to 0.060 inch (1.524 mm). In particular, the face portion 145 may define a thin front cavity wall reinforced by the filler material 560. Accordingly, the structural support provided by the filler material 560 may allow for having relatively thinner face portion and cavity walls. With reference to FIG. the face portion 145 may include a plurality of grooves 1000 defined by a perimeter groove 1010, a first plurality of grooves (e.g., shown as grooves 1021, 1022, and 1023), and a second plurality of grooves (e.g., shown as grooves 1031, 1032, and 1033). In the example of FIG. 10, dashed lines have been overlaid onto the perimeter groove 1010 and the example grooves for ease of reference and purposes of understanding. In the illustrated example, the perimeter groove 1010 may define a boundary enclosing the first plurality of grooves and the second plurality of grooves. The first plurality of grooves may be arranged in parallel with one another and may extend in a first diagonal direction across face portion 145 within the boundary set by the perimeter groove 1010. The second plurality of grooves may be arranged in parallel with one another and may extend in a second diagonal direction within the boundary set by the perimeter groove 1010. Each groove of the first plurality of grooves and the second plurality of grooves may terminate at the perimeter groove 1010. In other words, the first plurality of grooves and the second plurality of grooves may be joined to the perimeter groove 1010 at their terminal ends. In one example, the first plurality of grooves may be transverse to the second plurality of grooves. Accordingly, the first plurality of grooves may intersect with the second plurality of grooves at right angles. The apparatus, methods, and articles of manufacture described herein are not limited in this regard.

With continued reference to FIG. 10, the plurality of grooves 1000 may define a first plurality of projections (e.g., shown as projections 1041, 1042, and 1043) and a second plurality of projections (e.g., shown as projections 1051, 1052, and 1053). Each projection (e.g., projection 1041) of the first plurality of projections may be disposed inward of the perimeter groove 1010 and may correspond to a raised structure occupying an intersectional space between two adjacent grooves (e.g., grooves 1021 and 1022) of the first plurality of grooves and two adjacent grooves (e.g., grooves 1031 and 1032) of the second plurality of grooves. In other words, each projection of the first plurality of projections may be bounded by two adjacent grooves of the first plurality of grooves and two adjacent grooves of the second plurality of grooves intersecting the two adjacent grooves of the first plurality of grooves. In one example, each projection of the first plurality of projections may have a frusto-pyramidal shape with a flat peak surface for striking a golf ball. Each projection (e.g., projection 1051) of the second plurality of projections may be disposed adjacent the perimeter groove 1010 and may correspond to a raised structure occupying an intersectional space between the perimeter groove 1010, at least one groove (e.g., groove 1023) of the first plurality of grooves, and at least one groove (e.g., groove 1031) of the second plurality of grooves. In other words, each projection of the second plurality of projections may be bounded by the perimeter groove 1010, at least one groove of the first plurality of grooves, and at least one groove of the second plurality of grooves intersecting the at least one groove of the first plurality of grooves. Each projection of the second plurality of projections may have a variety of shapes based on the intersectional relationship between the perimeter groove 1010, the first plurality of grooves, and the second plurality of grooves. In one example, each projection of the second plurality of projections may correspond to a partial segment of a projection of the first plurality of projections. While the examples and figures described herein may describe and depict a face portion having particular projections, the apparatus, methods, and articles of manufacture described herein may include projections of other suitable shapes, size, position, etc. For example, the face portion 145 may include at two projections with different shape or size. Alternatively, the face portion 145 may not include a projection. In one example, the face portion 145 may include one or more horizontal grooves extending between the toe portion 120 and the heel portion 130. In another one example, the face portion 145 may include a smooth flat surface or a smooth contoured surface. The apparatus, methods, and articles of manufacture described herein are not limited in this regard.

Figure 11:
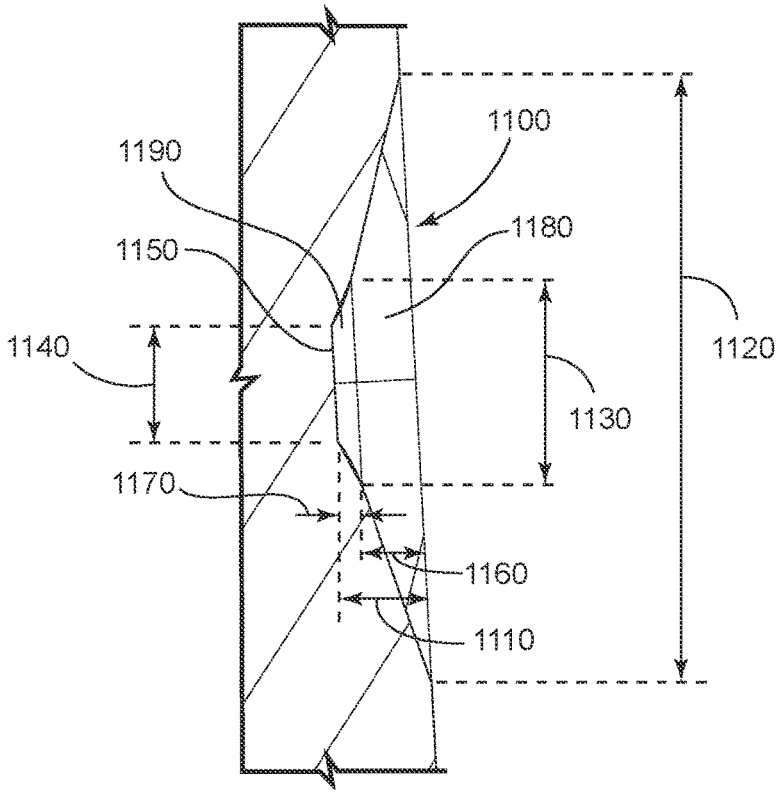
FIG. 11 depicts a schematic cross-sectional view of a representative groove of the face portion of FIG. 10 according to an embodiment of the apparatus, methods, and articles of manufacture described herein.

The first plurality of grooves and the second plurality of grooves may have similar groove properties (e.g., width and depth) and may be evenly spaced apart such that the first plurality of projections are the same size and shape. For purposes of understanding, an example groove 1100 is shown in FIG. 11 and may be representative of any groove of the first plurality of grooves and the second plurality of grooves. In the present example, the groove 1100 may have a depth 1110 greater than or equal to 0.010 inch (0.254 mm) and less than or equal to 0.015 inch (0.381 mm). The groove 1100 may have a variable width that decreases at a first rate from an upper width 1120 at the top of the groove 1100 to an intermediate width 1130 and decreases at a second rate from the intermediate width 1130 to a lower width 1140 at a base 1150 of the groove 1100. In one example, the upper width 1120 may be greater than or equal to 0.045 inch (1.143 mm) and less than or equal to 0.060 inch (1.524 mm), the intermediate width 1130 may be greater than or equal to 0.015 inch (0.381 mm) and less than or equal to 0.020 inch (0.508 mm), and the lower width may be greater than or equal to 0.009 inch (0.2286 mm) and less than or equal to 0.012 inch (0.3048 mm). Additionally, a rate of decrease from the upper width 1120 to the intermediate width 1130 may occur linearly over a depth 1160 greater than or equal to 0.007 inch (0.1778 mm) and less than or equal to 0.010 inch (0.254 mm) and a rate of decrease from the intermediate width 1130 to the lower width 1140 may occur non-linearly over a depth 1170 greater than or equal 0.003 inch (0.0762 mm) and less than or equal to 0.005 inch (0.127 mm). In the example of FIG. 11, the groove 1100 may be characterized as having an upper cross-section 1180 with an inverted frustoconical shape and a lower cross-section 1190 with an inverted truncated funnel shape. The apparatus, methods, and articles of manufacture described herein are not limited in this regard.

Figure 12:
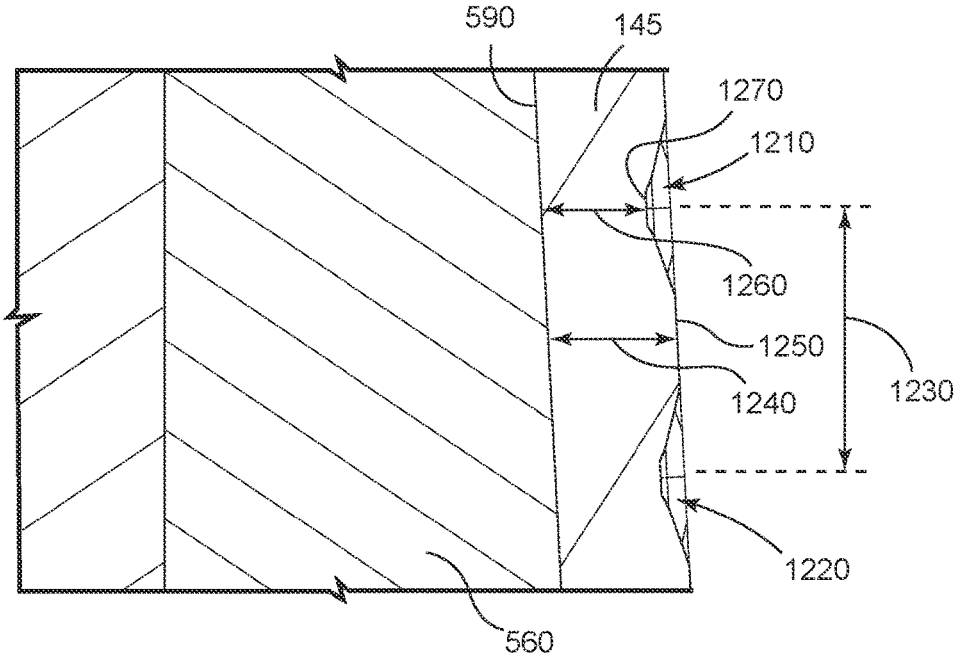
FIG. 12 depicts a schematic cross-sectional view of two representative grooves of the face portion of FIG. 10 according to an embodiment of the apparatus, methods, and articles of manufacture described herein.

Referring to FIG. 12, two adjacent grooves are shown as grooves 1210 and 1220 and may be representative of any two adjacent grooves of the first plurality of grooves or any two adjacent grooves of the second plurality of grooves. In the present example, a centerline spacing 1230 between grooves 1210 and 1220 may be greater than or equal to 0.060 inch (1.524 mm) and less than or equal to 0.100 inch (2.54 mm). In the present example, the face portion 145 may have a first face thickness 1240 greater than or equal to 0.035 inch (0.889 mm) and less than or equal to 0.055 inch (1.397 mm). The first face thickness 1240 may correspond to a distance between the rear surface 590 of the face portion 145 and a strike surface 1250 of the face portion 145, which may include the flat peak surfaces of the first plurality of projections. In one example, the flat peak surfaces of the first plurality of projections may be coplanar. The face portion 145 may also have a second face thickness 1260 greater than or equal to 0.035 inch (0.889 mm) and less than or equal to 0.045 inch (1.143 mm). The second face thickness 1260 may correspond to a distance between the rear surface 590 of the face portion 145 and a base (e.g., shown as base 1270) of a groove (e.g., groove 1210). In one example, the bases of the first plurality of grooves and the second plurality of grooves may be coplanar. The face portion 145 incorporating the plurality of grooves 1000 described herein may cooperate with the filler material 560 to provide enhanced performance properties such as consistent roll distance and improved feel and sound. The configurations and properties of the face portion and the plurality of grooves may be similar in many respects to the face portion and the plurality of the grooves described in U.S. Pat. Nos. 10,737,153 and 10,981,038, which are incorporated by reference herein. The apparatus, methods, and articles of manufacture described herein are not limited in this regard.

The mass properties of the golf club head 100 may be adjusted using a weighting system that may utilize a plurality of weight ports (e.g., toe-side weight port 220 and heel-side weight port 230) and corresponding interchangeable weight portions (e.g., weight portions 240 and 250). In one example, weight portions 240 and 250 may have the same mass and coupled the toe-side weight port 220 and the heel-side weight port 230, respectively, to provide balanced weighting to the golf club head 100. In another example, weight portion 240 may have a greater mass than weight portion 250, and weight portions 240 and 250 may be coupled the toe-side weight port 220 and the heel-side weight port 230, respectively, to counteract an individual's tendency to pull putts by restricting club head rotation and face closure during a putting stroke. In yet another example, weight portion 240 may have a lower mass than weight portion 250, and weight portions 240 and 250 may be coupled the toe-side weight port 220 and the heel-side weight port 230, respectively, to counteract an individual's tendency to push putts by promoting club head rotation and face closure during a putting stroke. The apparatus, methods, and articles of manufacture described herein are not limited in this regard.

Figure 13:
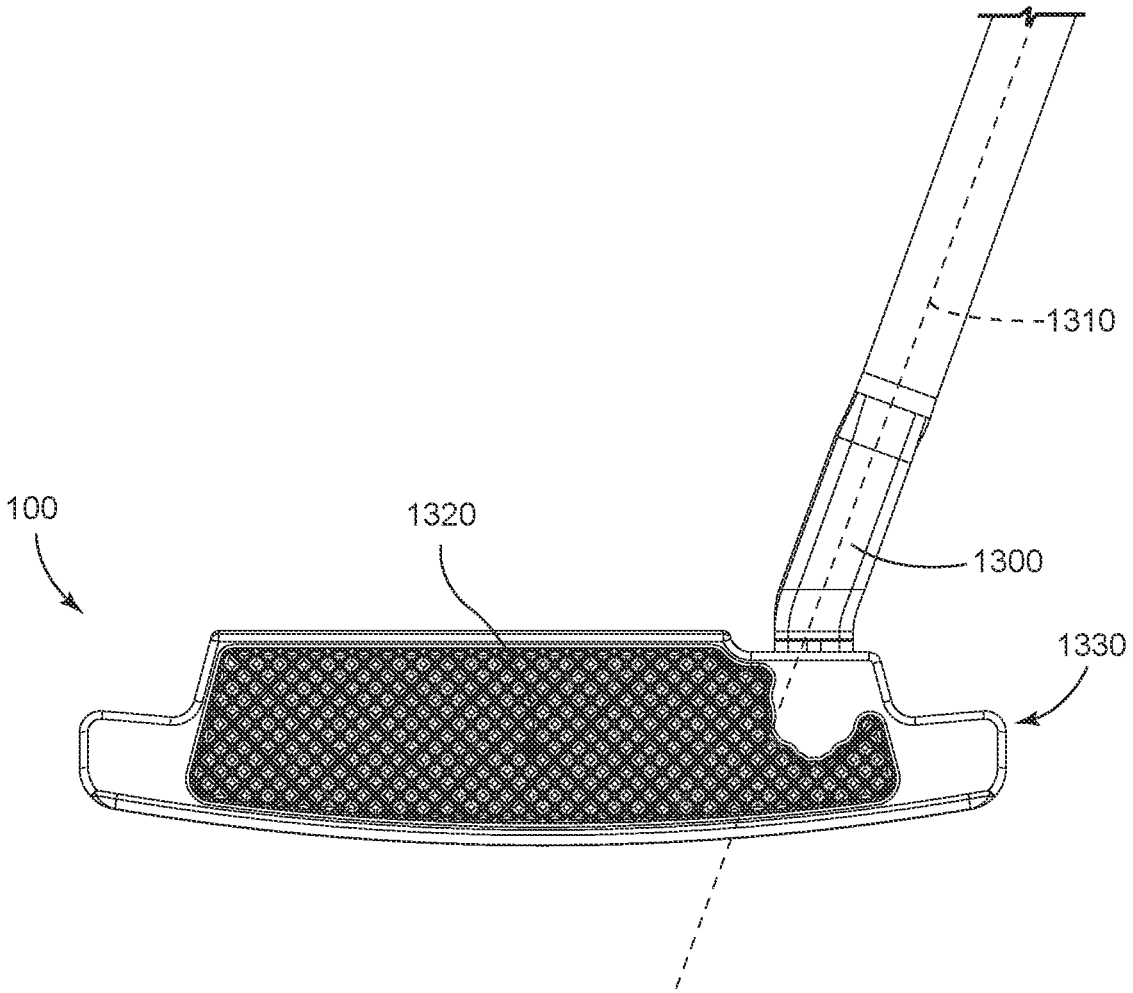
FIGS. 13, 14, and 15 depict a front elevational view of the golf club head of FIGS. 1-9 assembled to a heel-shafted hosel type, a double bend hosel type, and a plumber's neck hosel type, respectively, according to an embodiment of the apparatus, methods, and articles of manufacture described herein.
Figure 14:
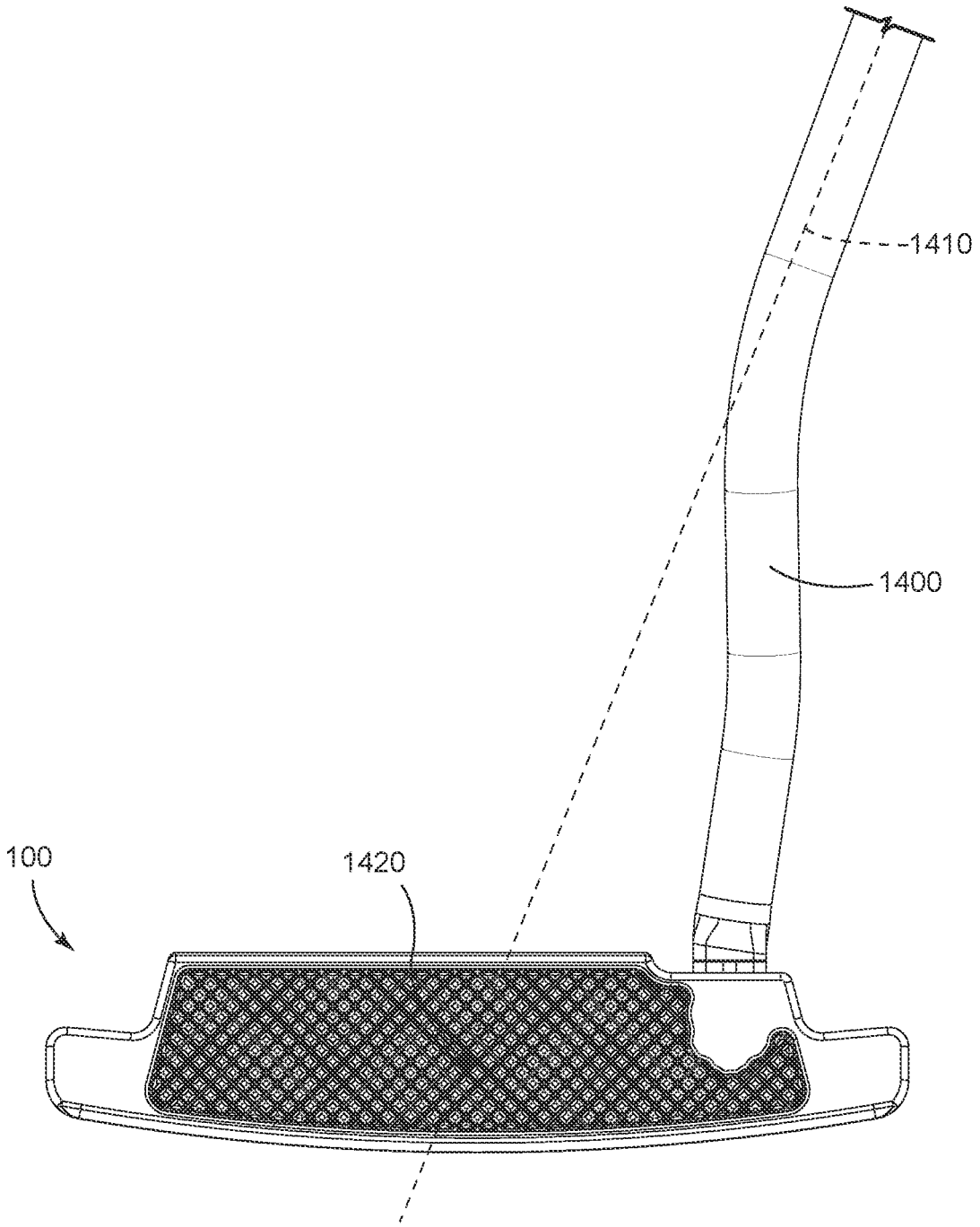
Figure 15:
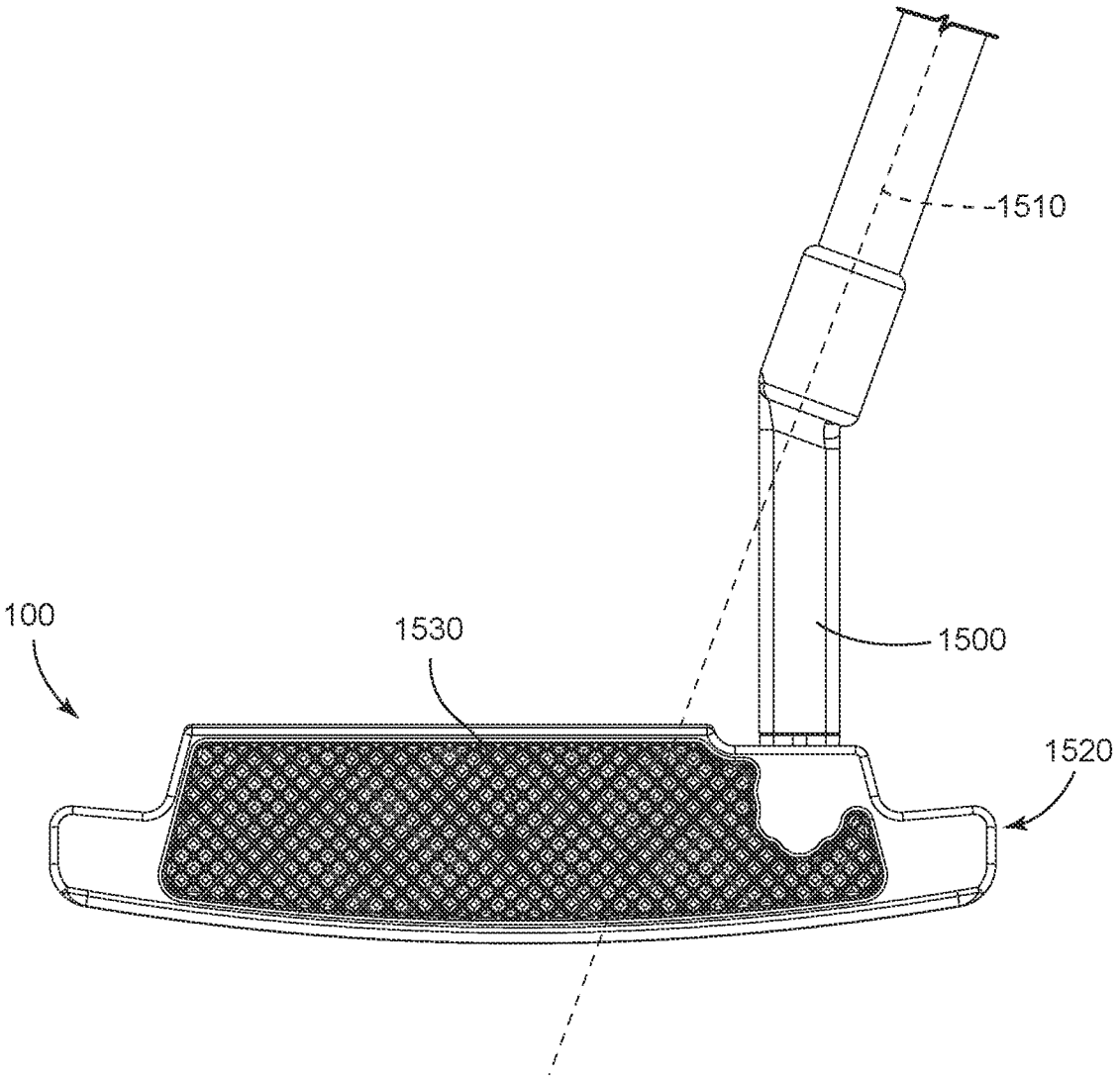
Figure 16:
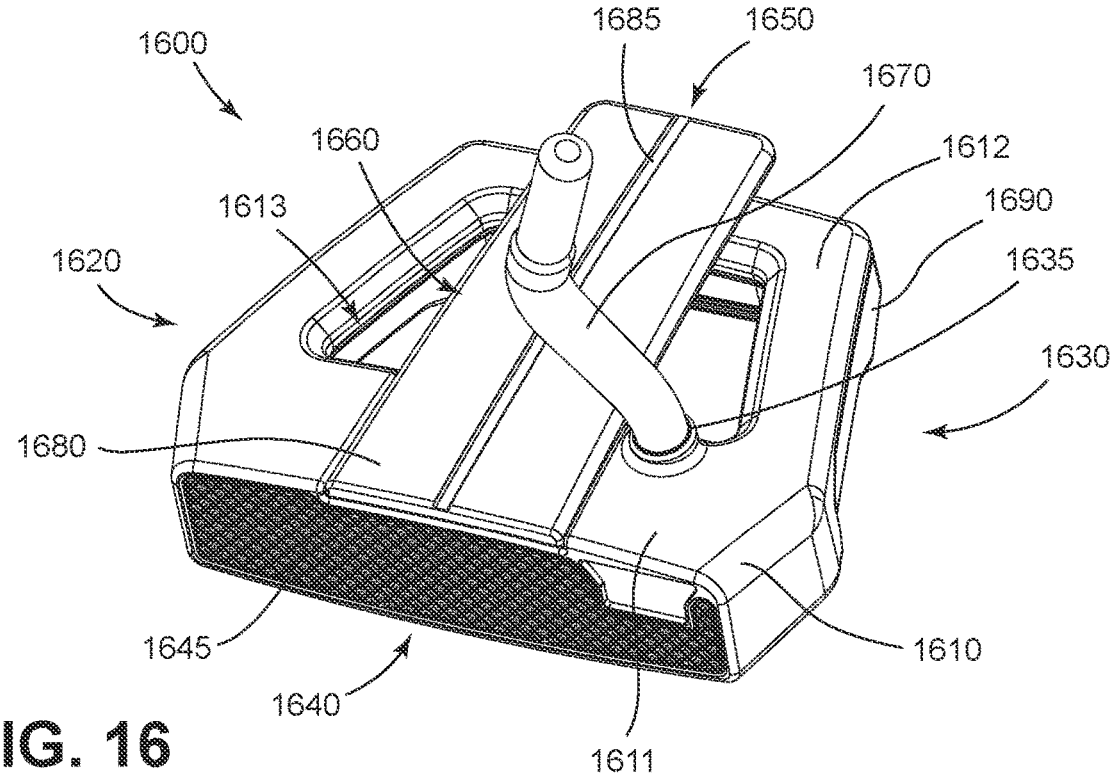
FIGS. 16, 17, 18, 19, 20, 21, 22, 23, 24, 25, 26, and 27 depict a perspective front view, a perspective rear view, a front elevational view, a rear elevational view, a top view, a bottom view, a left view, a right view, an exploded top perspective view, an exploded bottom perspective view, a perspective cross-sectional view (along line 26-26 of FIG. 18), and a perspective cross-sectional view (along line 27-27 of FIG. 18), respectively, of a golf club head according to an embodiment of the apparatus, methods, and articles of manufacture described herein.
Figure 17:
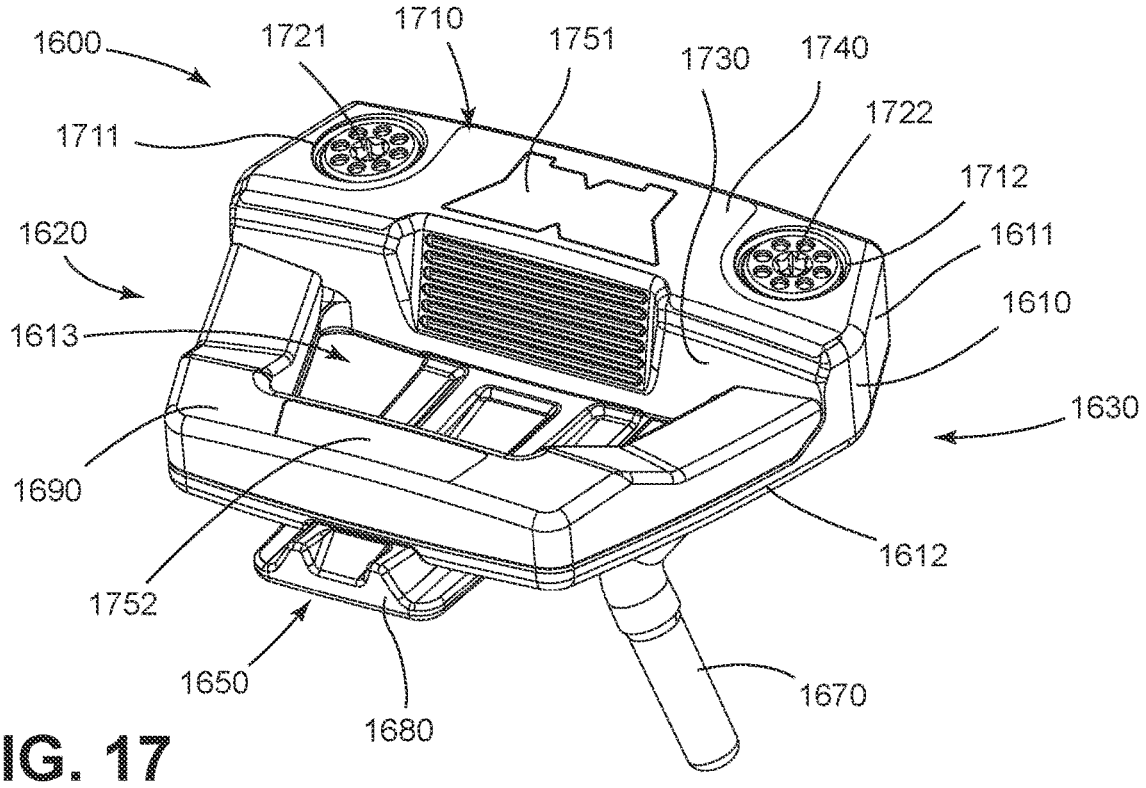
Figure 18:
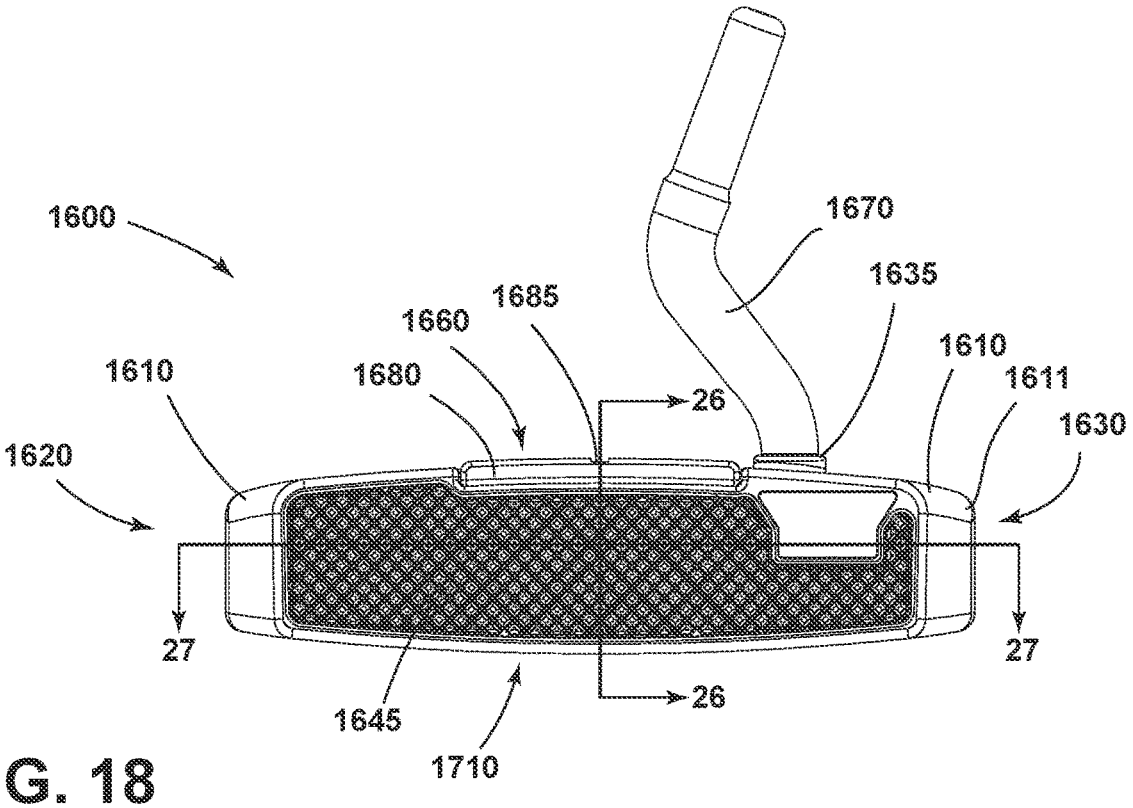
Figure 19:
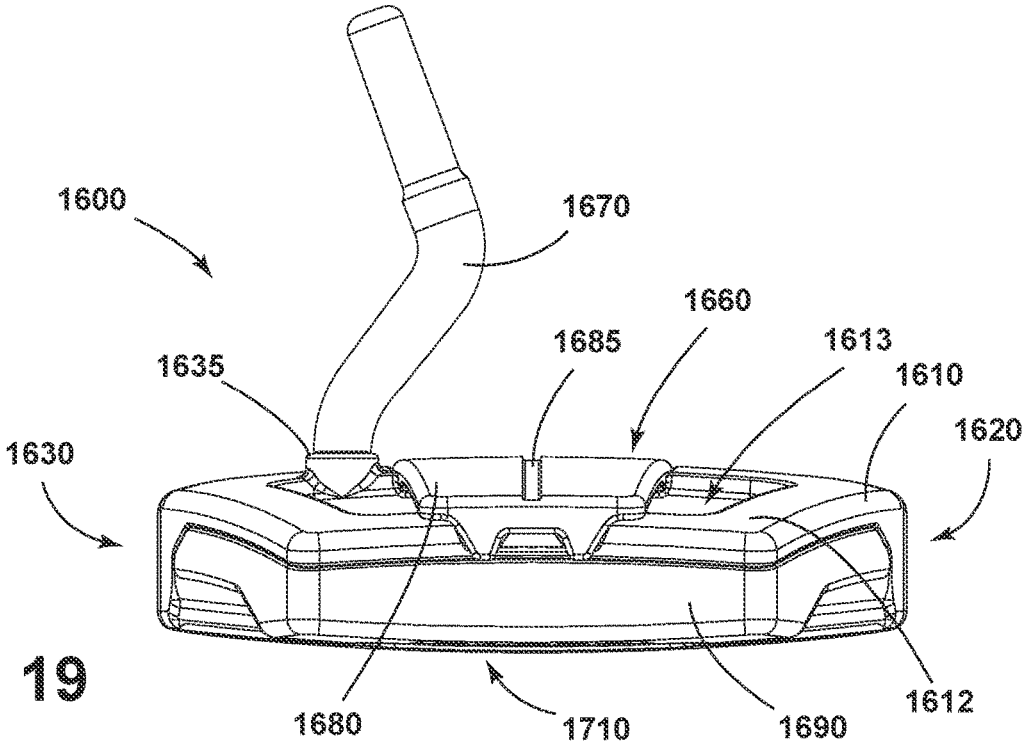

The mass properties of the golf club head 100 may be further adjusted with an interchangeable hosel system that may utilize a hosel bore instead of a fixed hosel (e.g., an integral portion of the body portion 110). Accordingly, the hosel bore 135 may be configured to receive a variety of hosel types to adjust the balance of the golf club head 100. In one example, as shown in FIG. 13, a hosel portion 1300 configured as a heel-shafted hosel type may be coupled to the hosel bore 135 to orient a shaft axis 1310 away from a CG location 1320 and more toward a heel portion 1330 of the golf club head 100 to increase the inertial force required to rotate the golf club head 100 during a putting stroke. A heel-shafted hosel may produce a large degree of toe hang (e.g., greater than 45 degrees) and may be preferred by individuals that tend to over-rotate the golf club head 100, thereby producing a closed face at impact. In another example, as shown in FIG. 14, a hosel portion 1400 configured as a double bend hosel type may be coupled to the hosel bore 135 to orient a shaft axis 1410 through a CG location 1420 to moderately reduce the inertial force required to rotate the golf club head 100 during a putting stroke. Alternatively, an armlock hosel type (not shown) may be used to accomplish the same. A double bend hosel type or armlock hosel type may promote face balancing and may be preferred by individuals that tend to under-rotate the golf club head 100 thereby producing an open face at impact. In yet another example, as shown in FIG. 15, a hosel portion 1500 configured as a plumber's neck hosel type may be coupled to the golf club head 100 to orient a shaft axis 1510 away from a heel portion 1520 and closer to a CG location 1530 of the golf club head 100 to significantly reduce the inertial force required to rotate the golf club head 100 during a putting stroke. A plumber's neck hosel type may produce a moderate degree of toe hang (e.g., less than or equal to 45 degrees) and may be preferred by individuals exhibiting mild levels of club head rotation. By employing one or both of the weighting system and the interchangeable hosel system described herein, the mass properties of the golf club head 100 may be adjusted to fit the needs of any individual regardless of putting style or swing tendencies while providing greater forgiveness due to the golf club head 100 benefitting from higher MOI compared to conventional solid-body golf club heads. While the examples and figures may describe and depict a hosel bore and a separate hosel portion, the apparatus, methods, and articles of manufacture described herein may include a hosel portion integral to the body portion. The apparatus, methods, and articles of manufacture described herein are not limited in this regard.

In the example of FIGS. 16-30, a golf club head 1600 is generally shown as a mid-mallet or mallet type putter. The golf club head 1600 may include a body portion 1610 having a toe portion 1620, a heel portion 1630, a hosel bore 1635, a front portion 1640, a face portion 1645, a rear portion 1650, a top portion 1660, and a sole portion 1710. The body portion 1610 may be made from any of the materials described herein or described in any of the incorporated by reference patent documents. The face portion 1645 may be located at the front portion 1640 and may define a front surface of the body portion 1610 for striking a golf ball (e.g., shown as golf ball 2900). The face portion 1645 may be generally planar and may have a loft angle that is greater than or equal to two degrees and less than or equal to four degrees. The sole portion 1710 may include a plurality of weight ports (e.g., shown as a toe-side weight port 1711 and a heel-side weight port 1712) each configured to receive a complementary weight portion (e.g., shown as weight portions 1721 and 1722). Weight portions 1721 and 1722 may be configured as interchangeable screws threadedly coupled to the toe-side weight port 1711 and the heel-side weight port 1712, respectively. Weight portions 1721 and 1722 may have similar or different material compositions and/or physical properties (e.g., density, color, texture) with respect to each other and the body portion 1610. The configuration and/or properties of each of the weight ports and the weight portions may be similar in many respects to any of the weight ports and weight portions described herein or described in any of the incorporated by reference patent documents. The hosel bore 1635 may be located at or proximate the heel portion 1630 and may be configured to receive a hosel portion 1670. The hosel portion 1670 may have similar or different material compositions and/or physical properties with respect to the body portion 1610. The hosel portion 1670 may be made from any of the materials described herein or described in any of the incorporated by reference patent documents. The apparatus, methods, and articles of manufacture described herein are not limited in this regard.

In one example, the body portion 1610 may be defined by a forward portion 1611 and an aft portion 1612 extending rearward from the forward portion 1611. The forward portion 1611 may extend from the face portion 1645 to a back wall portion 1730 opposite to the face portion 1645. The back wall portion 1730 may extend between the toe portion 1620 and the heel portion 1630 and may be located between the front portion 1640 and the rear portion 1650. The aft portion 1612 may extend rearward from the back wall portion 1730 and may include the rear portion 1650. In one example, the aft portion 1612 may be cantilevered from the forward portion 1611. Collectively, the forward portion 1611 and the aft portion 1612 may partially enclose a central void space 1613 of the body portion 1610. In one example, the central void space 1613 may extend in a top-to-sole direction. In another example, the central void space 1613 may extend in a toe-to-heel direction. The body portion 1610 may include an interior cavity 2500 that interfaces with an opening 2510 located at the sole portion 1710. The interior cavity 2500 may be provided within the forward portion 1611 and may extend between the face portion 1645 and the back wall portion 1730. The interior cavity 2500 may also extend between the top portion 1660 and the sole portion 1710 and between the toe portion 1620 and the heel portion 1630. A sole plate 1740 may be coupled to the body portion 1610 to close the opening 2510. The sole plate 1740 may have similar or different material compositions and/or physical properties as the body portion 1610. The sole plate 1740 may include any of the materials described herein or described in any of the incorporated by reference patent documents. In one example, the sole plate 1740 may be made from a material having a density that is less than a density of the body portion 1610 to enable greater discretionary mass placement in other regions of the golf club head 1600. The sole plate 1740 may be welded to the body portion 1610 or otherwise attached to the body portion 1610 using adhesive and/or mechanical fasteners. The apparatus, methods, and articles of manufacture described herein are not limited in this regard.

A central portion 1680 may be coupled to the body portion 1610 and may be configured to extend across the central void space 1613 in a front-to-rear direction. The central portion 1680 may be located at the top portion 1660 and may bridge the front portion 1640 and the rear portion 1650. In one example, the central portion 1680 may extend farther rearward than the rearmost extent of the aft portion 1612. The central portion 1680 may include any type of alignment aid. In one example, as illustrated in FIGS. 16-30, an alignment aid 1685 is generally shown as a line extending longitudinally across the central portion 1680 to assist an individual with addressing the golf club head 100 to the golf ball 2900. The central portion 1680 may have similar or different material compositions and/or physical properties as the body portion 1610. The central portion 1680 may include any of the materials described herein or described in any of the incorporated by reference patent documents. In one example, the central portion 1680 may be made from a material having a density that is less than a density of the body portion 1610 to enable greater discretionary mass placement in other regions of the golf club head 1600. Accordingly, the central portion 1680 may be provided as a separate piece attached to the body portion 1610. In another example, the central portion 1680 may be co-manufactured with the body portion 1610 so as to be a continuous one-piece part with the body portion 1610. In another example, all or portions of the central portion 1680 may have different surface visual effects such as surface texture, geometric shapes (e.g., a circle resembling a golf ball), alphanumeric information and/or one or more colors to further assist in the alignment aid functionality of the central portion 1680. The apparatus, methods, and articles of manufacture described herein are not limited in this regard.

A lower portion 1690 may be coupled to the body portion 1610 and may provide structural support to the aft portion 1612. The lower portion 1690 may undergird the aft portion 1612 and may be configured with a complementary shape to the aft portion 1612 so as not to obstruct the central void space 1613. The lower portion 1690 may have similar or different material compositions and/or physical properties as the body portion 1610. The lower portion 1690 may include any of the materials described herein or described in any of the incorporated by reference patent documents. In one example, the lower portion 1690 may be made from a material having a density that is less than a density of the body portion 1610 to enable greater discretionary mass placement in other regions of the golf club head 1600. To this end, the lower portion 1690 may be made from a lightweight material that is resistant to deformation (e.g., a composite material). Accordingly, the lower portion 1690 may be provided as a separate piece attached to the body portion 1610. In another example, the lower portion 1690 may be co-manufactured with the body portion 1610 so as to be a continuous one-piece part with the body portion 1610. The apparatus, methods, and articles of manufacture described herein are not limited in this regard.

In assembly, the central portion 1680 may include a front end portion 2411 and a rear end portion 2412, each of which may be at least partially received in a complementary recess (e.g., shown as recess 2421 and recess 2422, respectively) at the top of the forward portion 1611 and at the top and rear of the aft portion 1612, respectively. The front end portion 2411 may include a boss 2520 received in a complementary indent 2430 in recess 2421 to properly position the central portion 1680 atop the body portion 1610. The boss 2520 may include a fastener port 2521 aligned with an opening 2431 extending through indent 2430 and interfacing with the interior cavity 2500. The fastener port 2521 and opening 2431 may be aligned with a through-port 2440 connected to a depression 2530 in an outer surface 2540 of the sole plate 1740. A mechanical fastener 2451 may be inserted into the through-port 2440 and threadedly engaged to fastener port 2521 via opening 2431 thereby joining the front end portion 2411 to the body portion 1610 and the sole plate 1740. The rear end portion 2412 may include a fastener port 2522 aligned with an opening 2432 in recess 2422 and a through-port 2461 connected to a depression 2550 in a lower outer surface 2560 of the lower portion 1690. A mechanical fastener 2452 may be inserted into the through-port 2461 and threadedly engaged to fastener port 2522 via opening 2432 thereby joining the rear end portion 2412 to the body portion 1610 and the lower portion 1690. In addition to mechanical fastener 2452, the lower portion 1690 may be attached to the underside of the aft portion 1612 using an adhesive. A complementary cover portion (e.g., shown as cover portions 1751 and 1752) may be received in each of depressions 2530 and 2550 to conceal corresponding mechanical fasteners 2451 and 2452, respectively. In one embodiment, cover portions 1751 and 1752 may each be configured as decorative badges and may be attached to corresponding depressions 2530 and 2550 using adhesive. The apparatus, methods, and articles of manufacture described herein are not limited in this regard.

The interior cavity 2500 may be partially or entirely filled with a filler material 2470. The filler material 2470 may include any of the filler materials described herein or described in any of the incorporated by reference patent documents. In one example, the filler material 2470 may include a low-density polymer material. In another example, the filler material 2470 may be a solid piece manufactured in the shape of the interior cavity 2500 so as to be insertable into the interior cavity 2500 through the opening 2510. In yet another example, the filler material 2470 may be an injectable liquid or fluid material provided to the interior cavity 2500 via one or more openings (e.g., opening 2510) and later hardened at ambient conditions or during a curing process. The filler material 2470 may be disposed within the interior cavity 2500 to contact and reinforce a rear surface 2570 of the face portion 1645 to reduce face deformation and also dampen sound and vibration. Additionally, the filler material 2470 may at least partially encase the depression 2530 and the through-port 2440 of the sole plate 1740. The filler material 2470 may provide structural support to the cavity walls and/or the face portion 1645 of the golf club head 1600. Accordingly, the cavity walls may be relatively thin to accommodate a greater amount of the filler material 2470 in the interior cavity 2500 and to provide increased discretionary mass, and the face portion 1645 may be relatively thin to provide a greater flexibility or rebounding effect. In one example, one or more cavity walls may have a thickness (constant or average) greater than or equal to 0.035 inch (0.889 mm) and less than or equal to 0.060 inch (1.524 mm). In another example, the face portion 1645 may have a face thickness 2600 in one or more areas greater than or equal to 0.035 inch (0.889 mm) and less than or equal to 0.055 inch (1.397 mm) (e.g., first face thickness 1240) and greater than or equal to 0.035 inch (0.889 mm) and less than or equal to 0.045 inch (1.143 mm) (e.g., second face thickness 1260) as described herein with reference to FIG. 12. In another example, the face portion 1645 may have a face thickness 2600 in one or more areas less than or equal to 0.035 inch (0.889 mm) or greater than or equal to 0.055 inch (1.397 mm). The face portion 1645 including the face thickness at one or more area on the face portion 1645 may be similar in many respects to any face portion (e.g., face portion 145) described herein or described in any of the incorporated by reference patent documents. The apparatus, methods, and articles of manufacture described herein are not limited in this regard.

Figure 26:
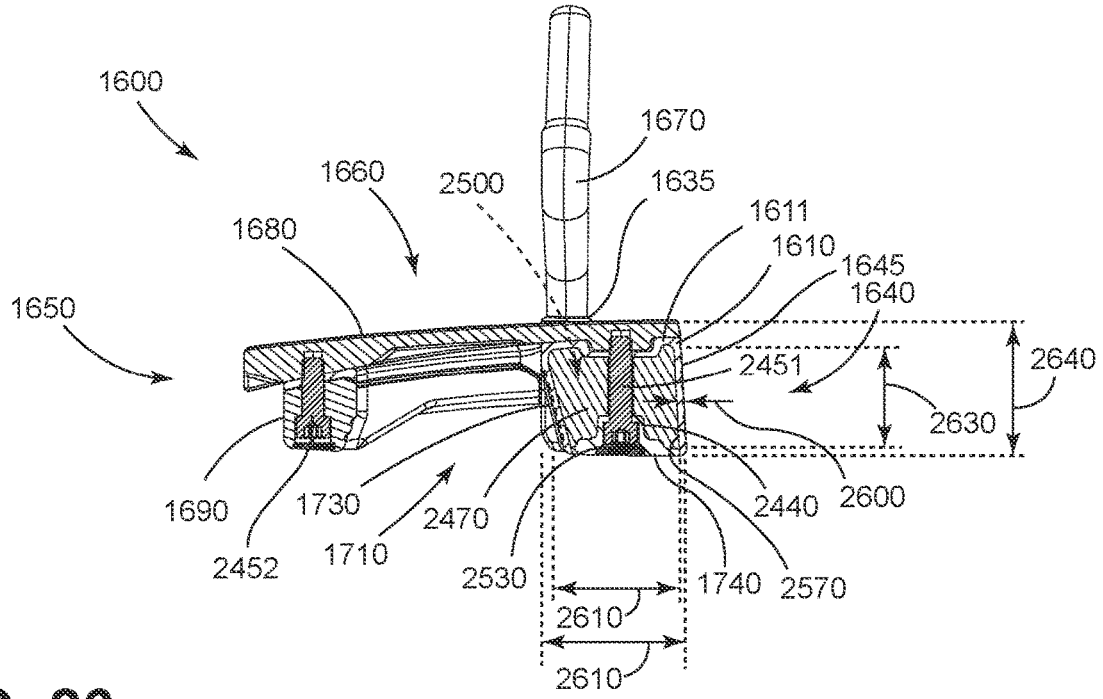
Figure 27:
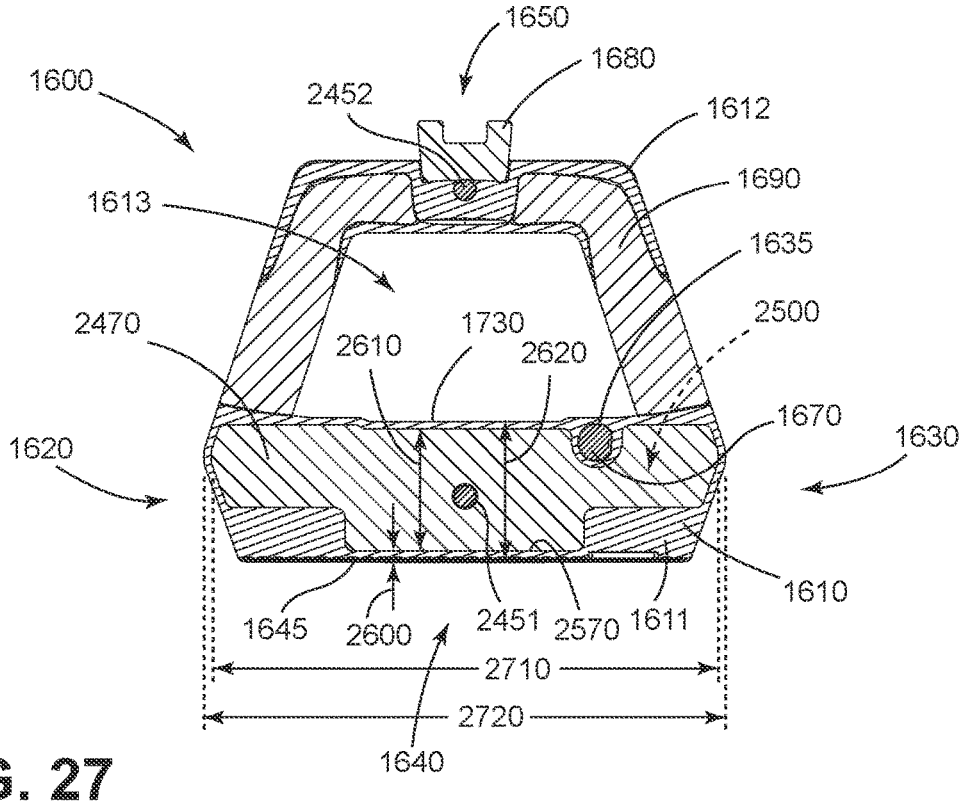

With reference to FIGS. 26 and 27, In one example, the golf club head 1600 may have at least one cross-section where the filler material 2470 has a length 2610 in a front-to-rear direction greater than or equal to 80% of a length 2620 between the face portion 1645 and the back wall portion 1730 in the front-to-rear direction. In another example, the golf club head 1600 may have at least one cross-section where the filler material 2470 has a length 2610 in a front-to-rear direction greater than or equal to 65% of a length 2620 between the face portion 1645 and the back wall portion 1730 in the front-to-rear direction. With reference to FIG. 26, in one example, the golf club head 1600 may have at least one cross-section where the filler material 2470 may have a length 2630 in a top-to-sole direction greater than or equal to 70% of a length 2640 of the body portion 1610 in the top-to-sole direction. In another example, the golf club head 1600 may have at least one cross-section where the filler material 2470 may have a length 2630 in a top-to-sole direction greater than or equal to 55% of a length 2640 of the body portion 1610 in the top-to-sole direction. With reference to FIG. 27, in one example, the golf club head 1600 may have at least one cross-section wherein the filler material 2470 has a length 2710 in a toe-to-heel direction greater than or equal to 90% of a length 2720 of the body portion 1610 in the toe-to-heel direction. In another example, the golf club head 1600 may have at least one cross-section wherein the filler material 2470 has a length 2710 in a toe-to-heel direction greater than or equal to 75% of a length 2720 of the body portion 1610 in the toe-to-heel direction. The apparatus, methods, and articles of manufacture described herein are not limited in this regard.

The filler material 2470 may have a density less than a density of the body portion 1610 to allow for more discretionary mass to be allocated to other areas of the golf club head 1600. With respect to the present example, the filler material 2470 may have a fill volume ($V_f$) greater than or equal to 30% and less than or equal to 40% of a total volume ($V_t$) of the golf club head 1600 (e.g., with or without the hosel portion 1670) and a fill mass ($M_f$) greater than or equal to 5% and less than or equal to 10% of a total mass ($M_t$) of the golf club head 1600 (e.g., with or without the hosel portion 1670). In one example, the total volume ($V_t$) of the golf club head 1600 may be greater than or equal to 5.40 $inch^3$ (88.490 $cm^3$) and less than or equal to 5.90 $inch^3$ (96.684 $cm^3$) and the total mass ($M_t$) of the golf club head 1600 may be greater than or equal to 320 grams and less than or equal to 370 grams. As described herein, selecting the filler material 2470 from a lightweight or low-density material and increasing the fill volume ($V_f$) of the filler material 2470 relative to the total volume ($V_t$) of the golf club head 1600 may enable greater discretionary mass placement toward a periphery of the golf club head 1600 to optimize certain mass properties of the golf club head 1600 such as MOI, CG location, and mass balance while maintaining a suitable club head weight. In one example, a ratio between a percentage fill volume $$\left(\frac{Vf}{Vt} \times 100\right)$$

and a percentage fill mass $$\left(\frac{Mf}{Mt} \times 100\right)$$

of the filler material 2470 may be greater than or equal to 3.00 and the golf club head 1600 may have a MOI greater than or equal to 4000 $g \cdot cm^2$. In another example, the golf club head 1600 may have a MOI greater than or equal to 4250 $g \cdot cm^2$. In yet another example, the golf club head 1600 may have a MOI greater than or equal to 4500 $g \cdot cm^2$. The apparatus, methods, and articles of manufacture described herein are not limited in this regard.

As described herein, the golf club head 1600 may include a weighting system that may utilize a plurality of weight ports (e.g., toe-side weight port 1711 and heel-side weight port 1712) and corresponding interchangeable weight portions (e.g., weight portions 1721 and 1722) to adjust the mass properties of the golf club head 1600. Additionally, as described herein, the hosel bore 1635 may be configured to receive any of the hosel types described herein or described in any of the incorporated by reference patent documents to further adjust the mass properties of the golf club head 1600. The apparatus, methods, and articles of manufacture described herein are not limited in this regard.

Figure 20:
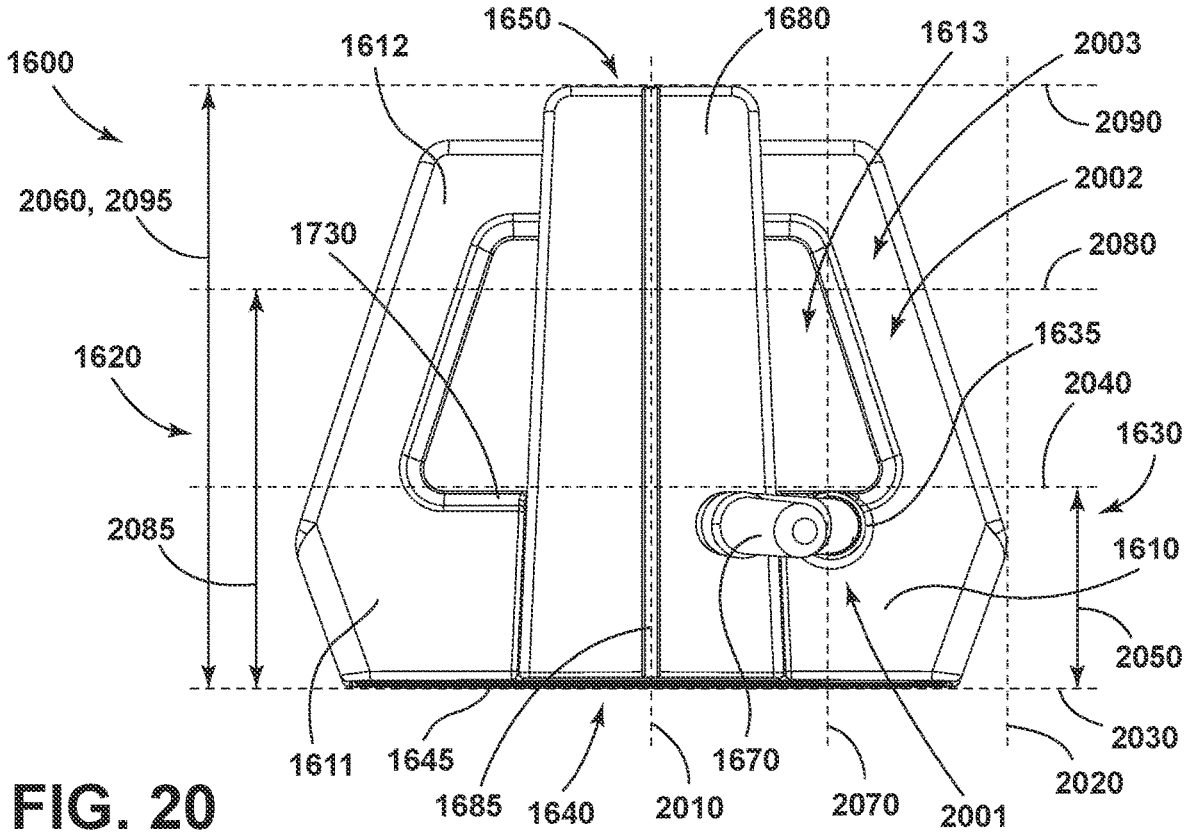
Figure 21:
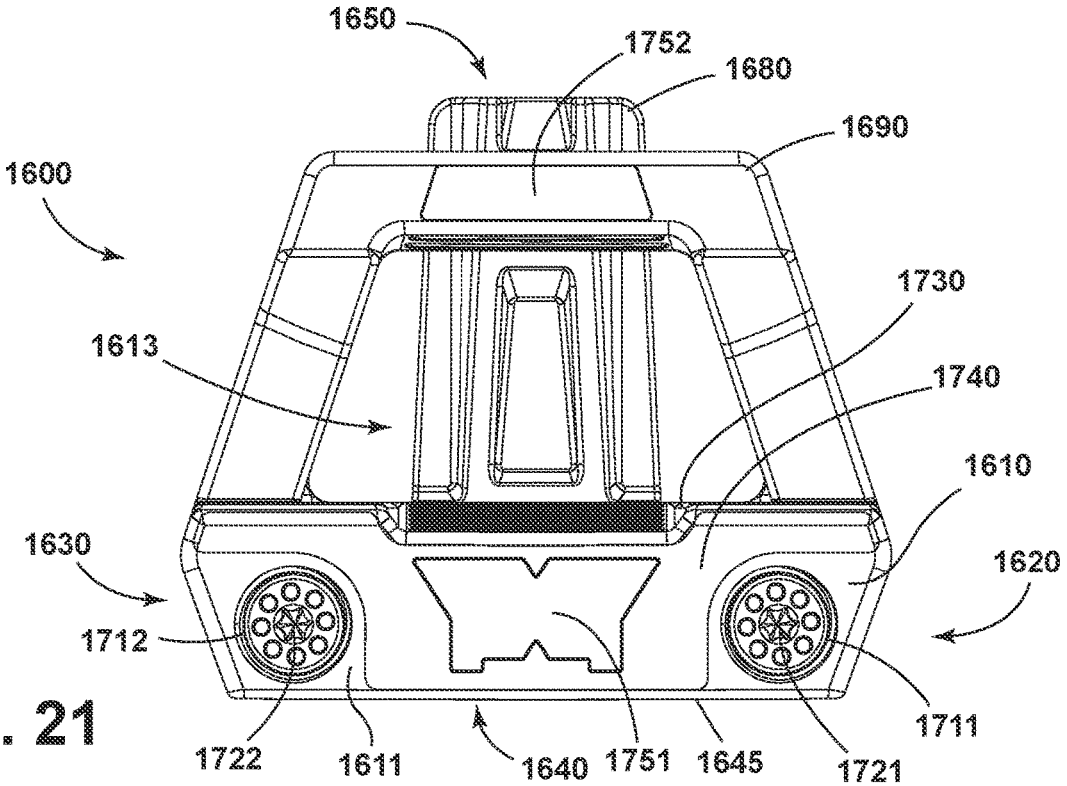
Figure 22:
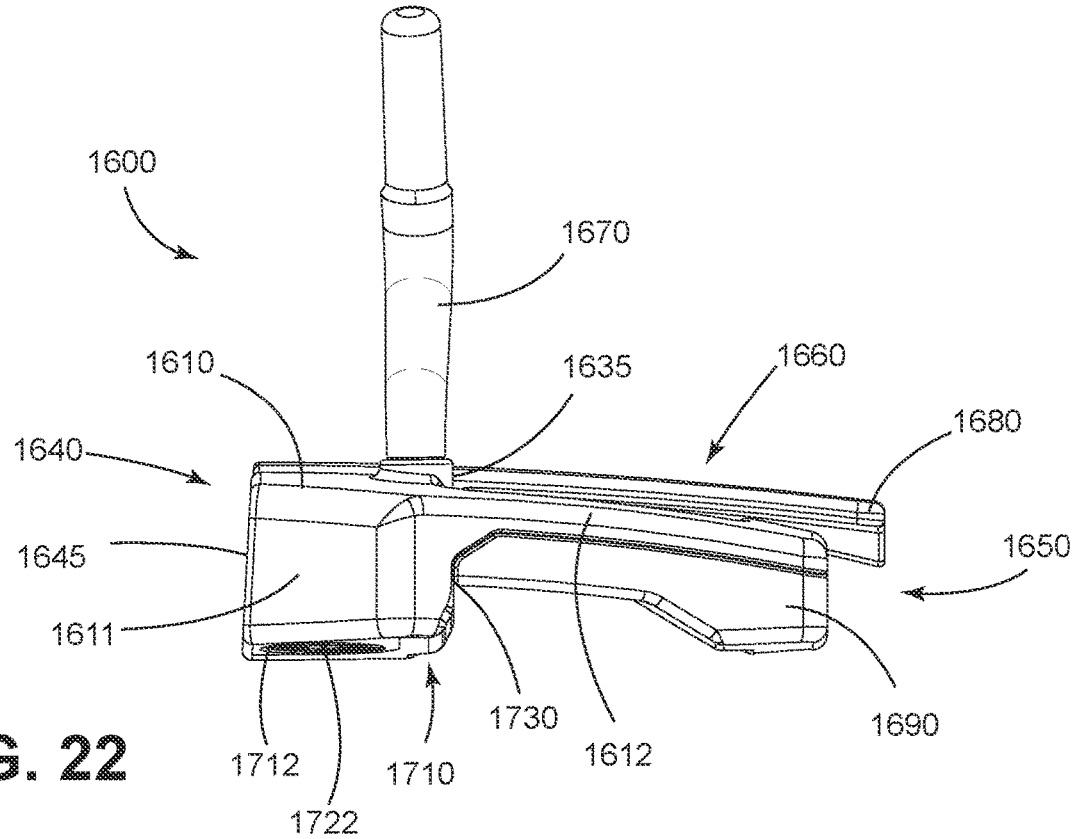
Figure 23:
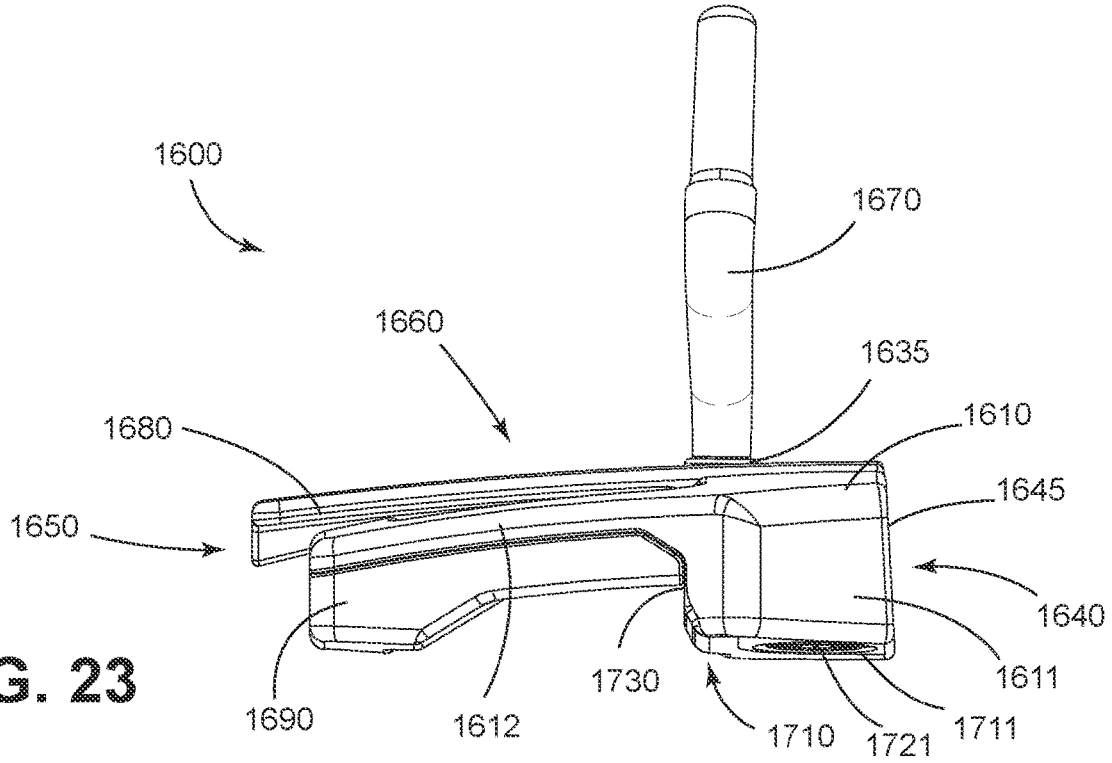
Figure 24:
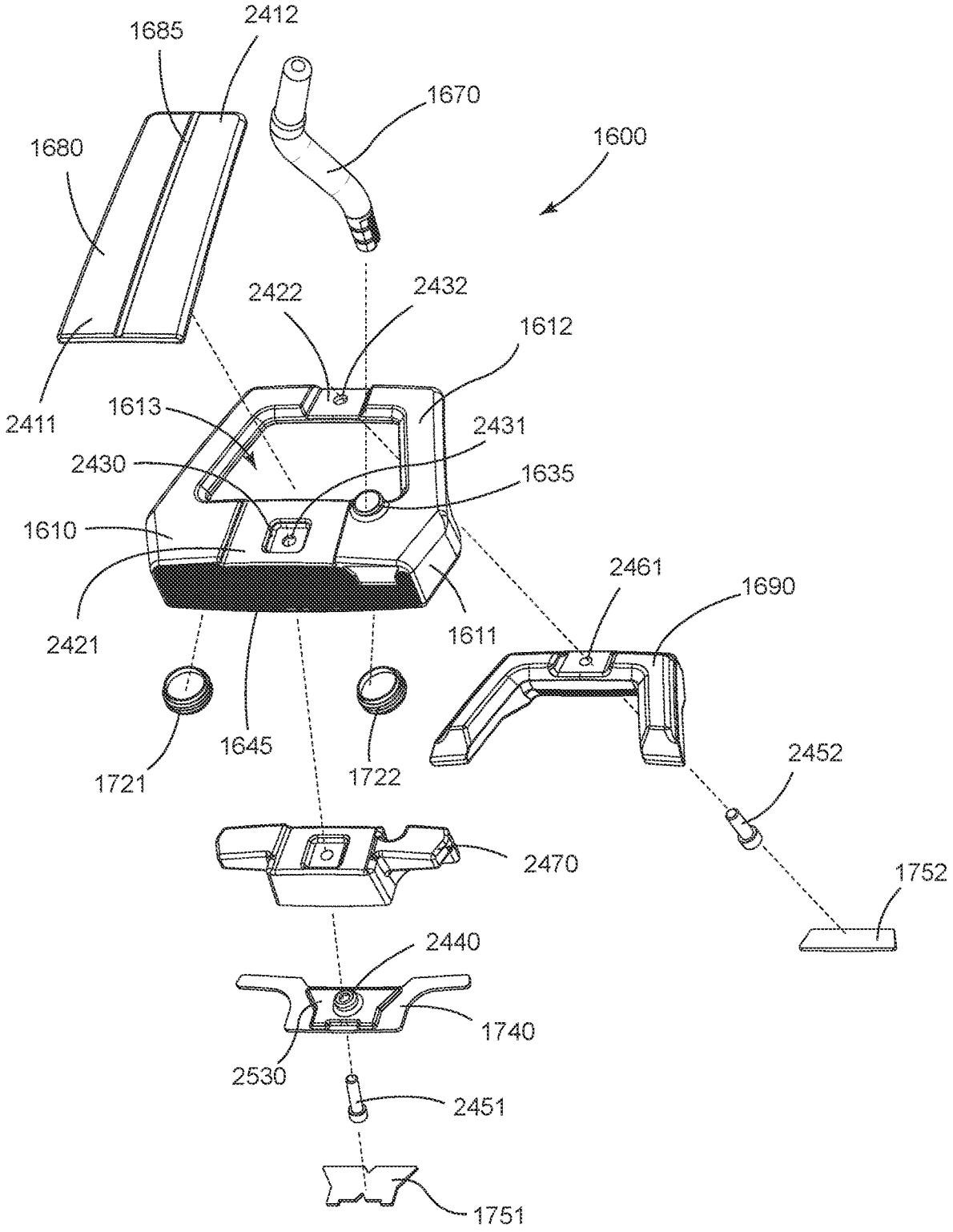
Figure 25:
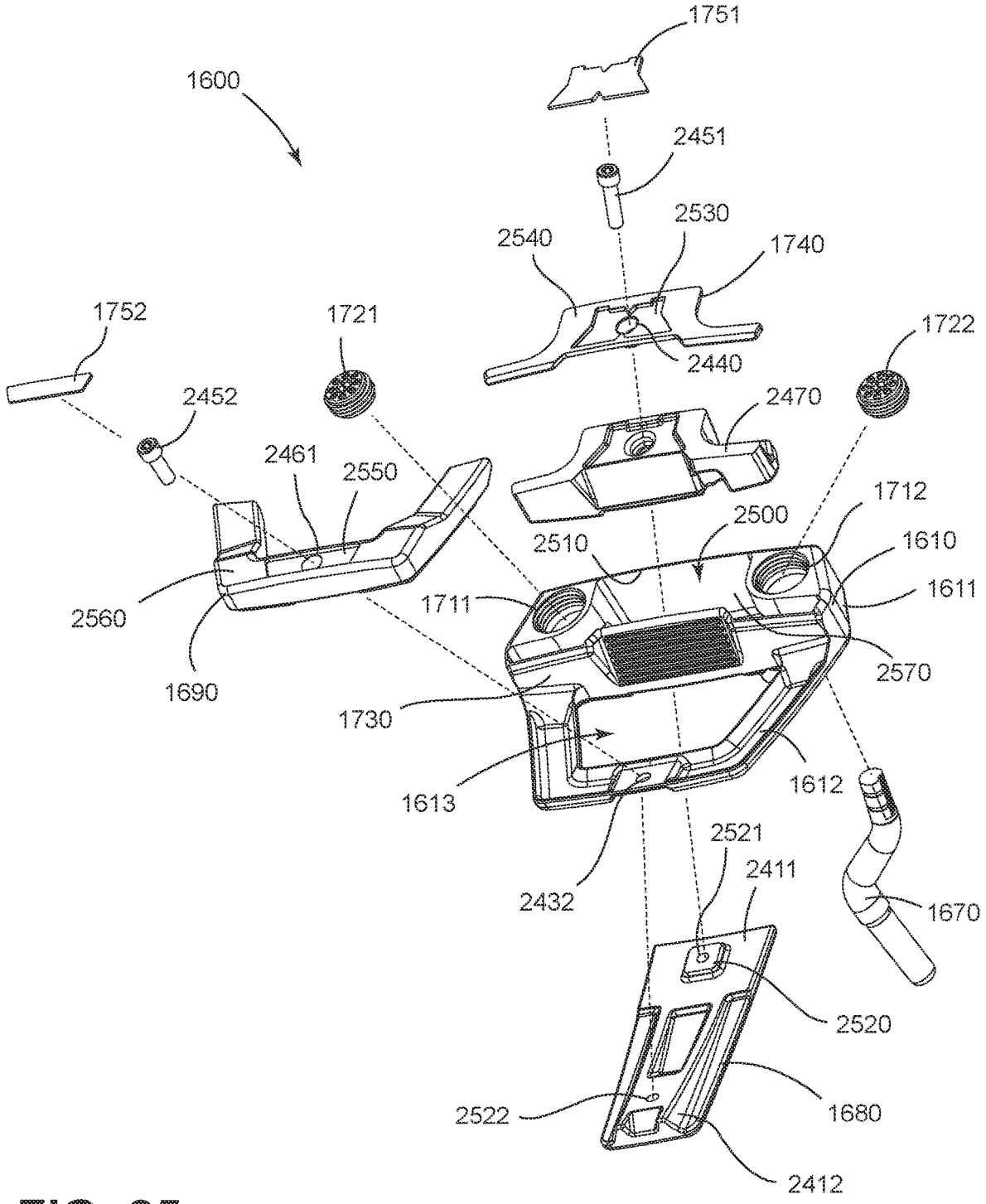
Figure 28:
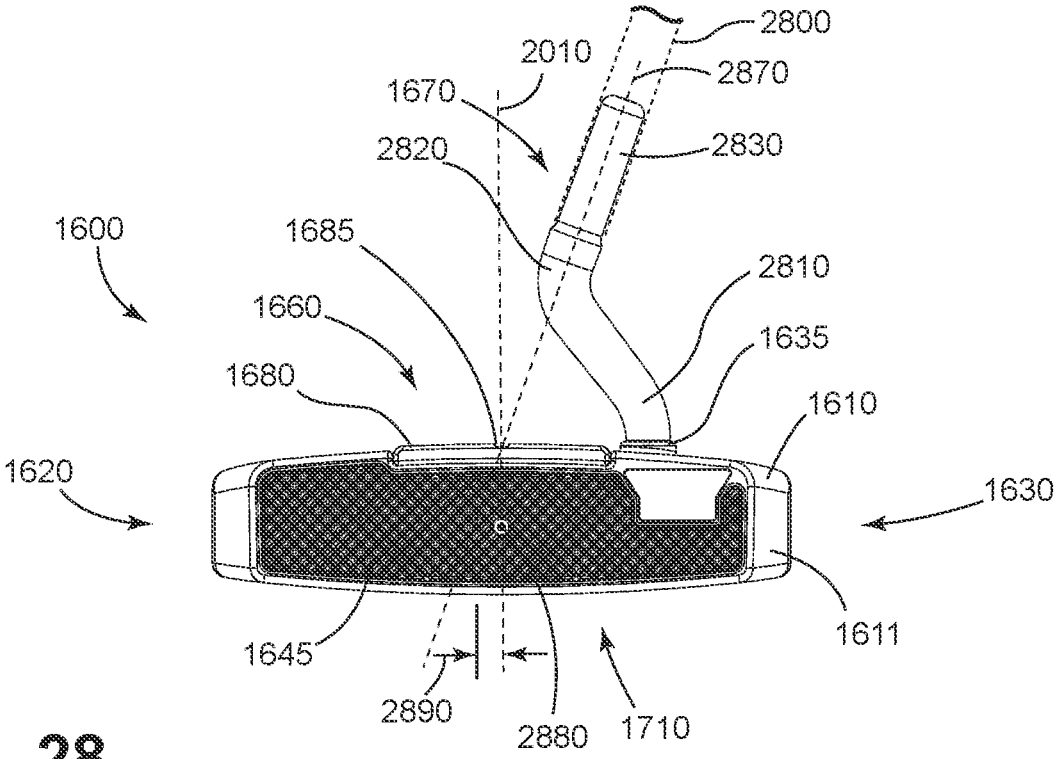
FIG. 28 depicts a shaft axis oriented toe-ward relative to a center of gravity of the golf club head of FIG. 16 according to an embodiment of the apparatus, methods, and articles of manufacture described herein.

With reference to FIG. 28, the hosel bore 1635 is shown coupled to the hosel portion 1670. The hosel portion 1670 may have a serpentine shape and may include a first bend portion 2810, a second bend portion 2820, and a tip portion 2830 configured to be received inside a golf shaft 2800. In one example, as shown in FIG. 20, the hosel bore 1635 and the hosel portion 1670 may be located at or proximate the heel portion 1630 and may be entirely disposed within a front space 2001 bounded by a center longitudinal plane 2010, a heel boundary plane 2020 parallel to the central longitudinal plane 2010, a front boundary plane 2030, and a first lateral plane 2040 parallel to the front boundary plane 2030 and separated from the front boundary plane 2030 by a distance 2050 equal to one third of a total length 2060 of the golf club head 1600 in the front-to-rear direction. The hosel bore 1635 and the hosel portion 1670 may be intersected by a heel dividing plane 2070 parallel to and equidistant from the center longitudinal plane 2010 and the heel boundary plane 2020. In another example, the hosel bore 1635 and the hosel portion 1670 may be partially or entirely disposed within a middle space 2002 bounded by the center longitudinal plane 2010, the heel boundary plane 2020, the first lateral plane 2040, and a second lateral plane 2080 parallel to the front boundary plane 2030 and separated from the front boundary plane 2030 by a distance 2085 equal to two thirds the total length 2060 of the golf club head 1600 in the front-to-rear direction. In yet another example, the hosel bore 1635 and the hosel portion 1670 may be partially or entirely disposed within a rear space 2003 bounded by the center longitudinal plane 2010, the heel boundary plane 2020, the second lateral plane 2080 and a third lateral plane 2090 parallel to the front boundary plane 2030 and separated from the front boundary plane 2030 by a distance 2095 equal to the total length 2060 of the golf club head 1600 in the front-to-rear direction. The apparatus, methods, and articles of manufacture described herein are not limited in this regard.

Figure 29:
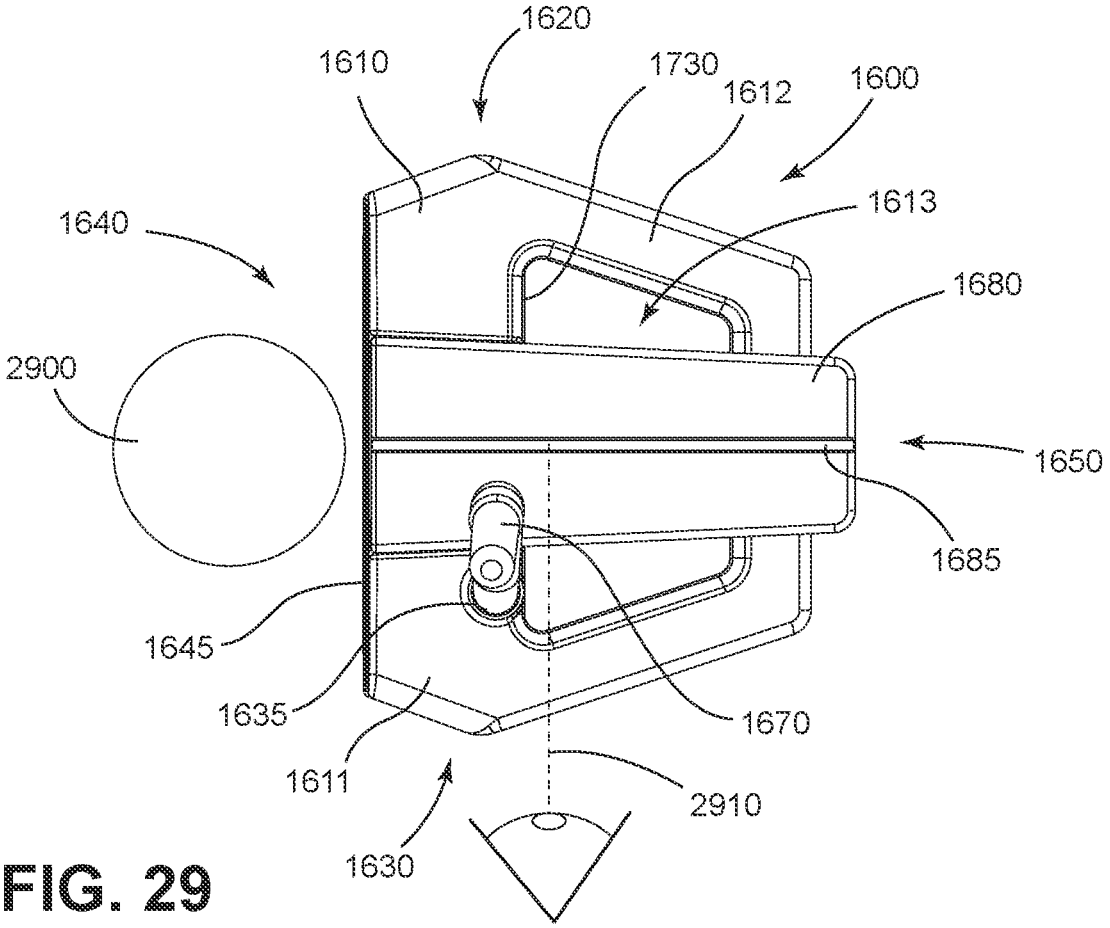
FIG. 29 depicts the golf club head of FIG. 16 at an address position according to an embodiment of the apparatus, methods, and articles of manufacture described herein.
Figure 30:
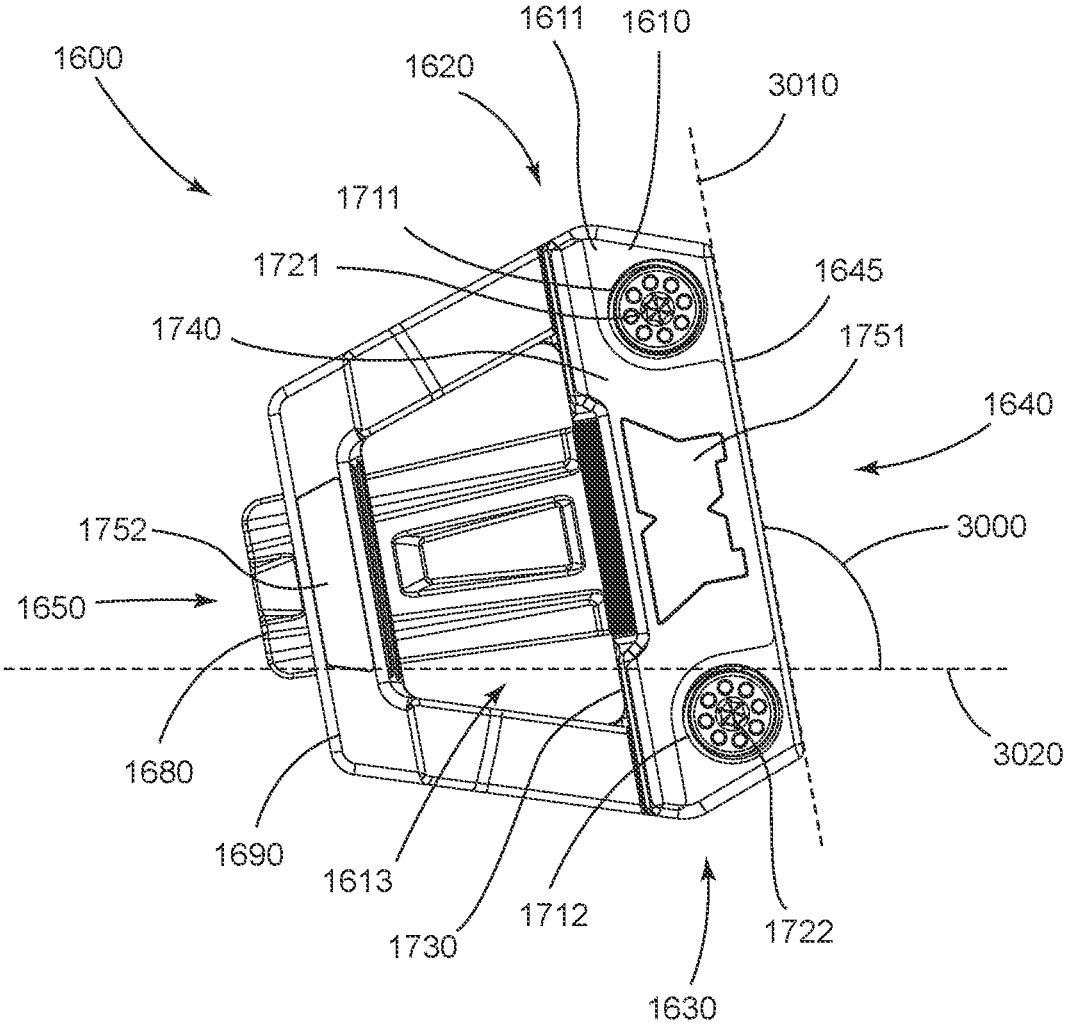
FIG. 30 depicts a hang angle of the golf club head of FIG. 16 according to an embodiment of the apparatus, methods, and articles of manufacture described herein.

Referring still to FIG. 28, the hosel portion 1670 may be configured to orient a shaft axis 2870 toe-ward relative to a CG location 2880 of the golf club head 1600. In other words, a distance between the shaft axis 2870 and the center longitudinal plane 2010 may increase in a heel-to-toe direction as the shaft axis 2870 extends from a location of intersection of the shaft axis 2870 and the center longitudinal plane 2010 toward the sole portion 1710. The shaft axis 2870 may intersect with the center longitudinal plane 2010 at or proximate (e.g., below) the alignment aid 1685 such that the hosel portion 1670 provides an unobstructed view 2910 of the alignment aid 1685 when the golf club head 1600 is addressed to the golf ball 2900 as shown in FIG. 29. In one example, a distance 2890 between the shaft axis 2870 and the CG location 2880 in the heel-to-toe direction may be greater than or equal to 3 mm and less than or equal to 10 mm toward the toe portion 1620. In another example, the distance 2890 between the shaft axis 2870 and the CG location 2880 may be greater than or equal to 4 mm and less than or equal to 8 mm toward the toe portion 1620. In yet another example, the distance 2890 between the shaft axis 2870 and the CG location 2880 may be greater than or equal to 5 mm and less than or equal to 6 mm toward the toe portion 1620. With respect to each of the foregoing examples, the shaft axis 2870 may have zero offset with the CG location 2880 in the front-to-rear direction or may be offset from the CG location 2880 toward the front portion 1640 or the rear portion 1650. In one example, the shaft axis 2870 and the CG location 2880 may be offset by a distance greater than or equal to 0 mm and less than or equal to 5 mm in the front-to-rear direction toward the front portion 1640 or the rear portion 1650. In another example, the shaft axis 2870 and the CG location 2880 may be offset by a distance greater than or equal to 0 mm and less than or equal to 4 mm in the front-to-rear direction toward the front portion 1640 or the rear portion 1650. In yet another example, the shaft axis 2870 and the CG location 2880 may be offset by a distance greater than or equal to 0 mm and less than or equal to 3 mm in the front-to-rear direction toward the front portion 1640 or the rear portion 1650. Additionally, the shaft axis 2870 may have zero offset with the CG location 2880 in the top-to-sole direction or may be offset from the CG location 2880 toward the top portion 1660 or the sole portion 1710. In one example, the shaft axis 2870 and the CG location 2880 may be offset by a distance greater than or equal to 0 mm and less than or equal to 5 mm in the top-to-sole direction toward the top portion 1660 or the sole portion 1710. In another example, the shaft axis 2870 and the CG location 2880 may be offset by a distance greater than or equal to 0 mm and less than or equal to 4 mm in the top-to-sole direction toward the top portion 1660 or the sole portion 1710. In yet another example, the shaft axis 2870 and CG location 2880 may be offset by a distance greater than or equal to 0 mm and less than or equal to 3 mm in the top-to-sole direction toward the top portion 1660 or the sole portion 1710. The amount of offset, if any, between the shaft axis 2870 and the CG location 2880 in the front-to-rear direction and/or the top-to-sole direction may be similar or different to the amount of offset between the shaft axis 2870 and the CG location 2880 in the heel-to-toe direction. Accordingly, any distance separating the shaft axis 2870 from the CG location 2880 in the front-to-rear direction and/or the top-to-sole direction may be similar or different to any of the distance 2890 examples described herein. In examples where the shaft axis 2870 is offset from the CG location 2880 toward the toe portion 1620, the hosel portion 1670 may allow the golf club head 1600 to balance in a toe-up position as shown in FIG. 30. For example, when the hosel portion 1670 is connected to a golf shaft resting on a flat horizontal surface and the golf club head 1600 is allowed to hang freely over an edge, the toe portion 1620 of the golf club head 1600 may point naturally in an upward direction such that a hang angle 3000 may be formed between a face plane 3010 and a horizontal plane 3020 parallel to or coinciding with the flat horizontal surface. In one example, the hang angle 3000 may be greater than 0 degrees and less than or equal to 45 degrees. In another example, the hang angle 3000 may be greater than or equal to 45 degrees and less than or equal to 90 degrees. In yet another example, the hang angle 3000 may be greater than or equal to 90 degrees and less than or equal to 135 degrees. In yet another example, the hang angle 3000 may be greater than or equal to 135 degrees and less than 180 degrees. A golf club employing a golf club head that balances toe-up may provide a similar feel to a face balanced golf club while also promoting greater face awareness compared to a conventional face balanced golf club. The apparatus, methods, and articles of manufacture described herein are not limited in this regard.

Figure 31:
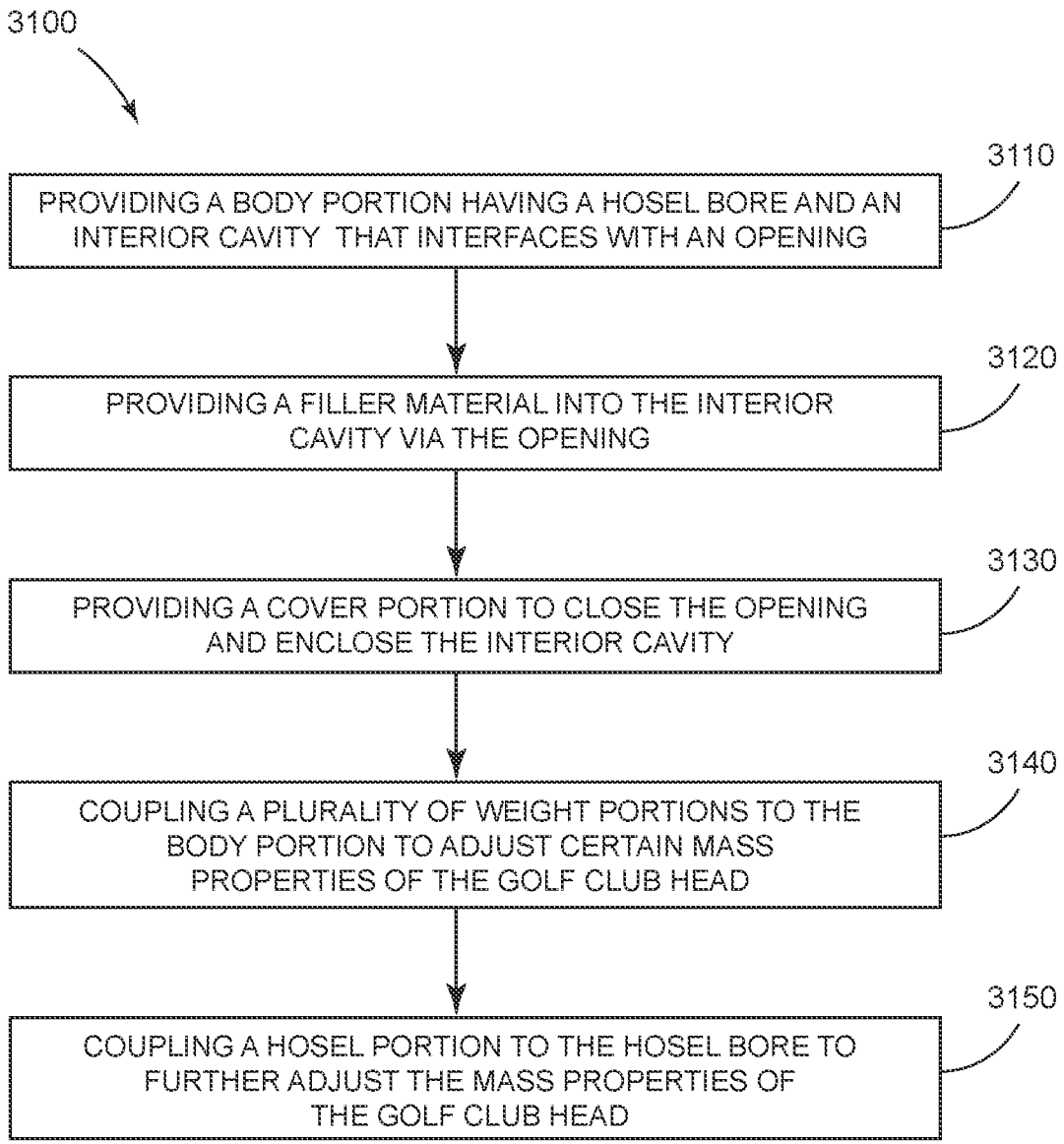
FIG. 31 depicts a manner in which any of the example golf club heads herein may be manufactured according to an embodiment of the apparatus, methods, and articles of manufacture described herein.

FIG. 31 depicts one manner by which any of the golf club heads described herein may be manufactured. In the example of FIG. 31, a process 3100 may begin with providing a body portion having a hosel bore and an interior cavity that interfaces with an opening (block 3110). A filler material may be provided into the interior cavity via the opening (block 3120). In one example, the filler material may be adapted as an injectable liquid polymer material and later hardened using a curing process. In another example, the filler material may be adapted as an insertable solid polymer material. As described herein, the filler material may reinforce a face portion of the golf club head and may enable greater discretionary mass placement in other areas of the golf club head to optimize certain mass properties such as MOI, CG location, and mass balance. A cover portion may be provided to close the opening and enclose the interior cavity (block 3130). A plurality of weight portions may be coupled to the body portion to adjust certain mass properties of the golf club head (block 3140). A hosel portion may be coupled to the hosel bore to further adjust the mass properties of the golf club head (3150). As described herein, the hosel portion may be selected from a variety of different hosel types based on a golfer's swing type and swing tendencies. In one example, the hosel portion may be configured to orient a shaft axis toe-ward relative to a CG location of the golf club head such that the golf club head balances in a toe-up position. The apparatus, methods, and articles of manufacture described herein are not limited in this regard.

Figure 32:
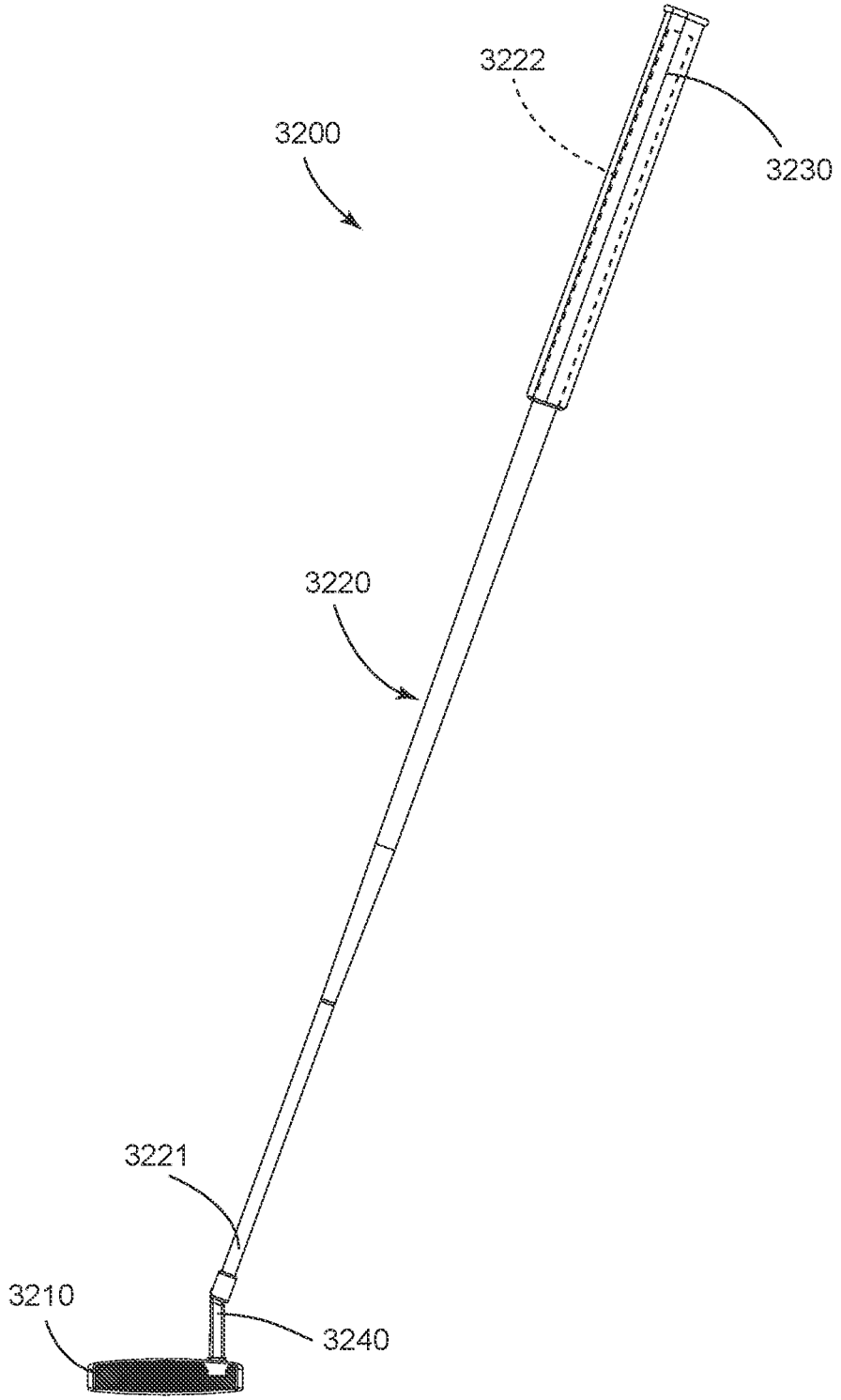
FIG. 32 depicts a golf club having a golf club head according to any embodiment of the apparatus, methods, and articles of manufacture described herein.

In the example of FIG. 32, a golf club 3200 may include a golf club head 3210, a shaft 3220, a grip 3230, and a hosel portion 3240. The shaft 3220 may have a tip end portion 3221 and a butt end portion 3222. The butt end portion 3222 of the shaft 3220 may be coupled to the grip 3230 and the tip end portion 3221 of the shaft 3220 may be coupled to the hosel portion 3240. The hosel portion 3240 may be coupled to the golf club head 3210 via a hosel bore as described herein. The golf club head 3210 and the hosel portion 3240 may include any of the golf club heads and hosel types described herein. The shaft 3220 may be formed from a metal material, a composite material, or any other suitable material or combination of materials. The grip 3230 may be formed from a rubber material, a polymer material, or any other suitable material or combination of materials. The apparatus, methods, and articles of manufacture described herein are not limited in this regard.

The filler materials described herein may include, but are not limited to, one or more polymer materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, the filler material may be one or more thermoset polymers having bonding properties (e.g., one or more adhesive or epoxy materials). The filler material may also absorb shock, isolate vibration, and/or dampen noise when the golf club head 100 strikes a golf ball. Further, the filler material may be an epoxy material that may be flexible or slightly flexible when cured. In another example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, the filler material may include 3M™ Scotch-Weld™ Epoxy Adhesive DP100 Plus Clear. In another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In another example, the filler material may be LOCTITE® materials manufactured by Henkel Corporation, Rocky Hill, Connecticut. In another example, the filler material may be a polymer material such as an ethylene copolymer material that may absorb shock, isolate vibration, and/or dampen noise when a golf club head strikes a golf ball via the face portion. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, the filler material may be formed from one or more metals or metal alloys, such as aluminum, copper, zinc, and/or titanium. A filler material not specifically described in detail herein may include one or more similar or different types of materials described herein. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all of the heating and cooling processes may be performed by using heating or cooling systems that employ conveyor belts that move a golf club head described herein through a heating or cooling environment for a period of time as described herein. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods, and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having toe portion, a heel portion, a front portion, a rear portion, a top portion, a sole portion, a hosel bore at the heel portion, and an interior cavity;

an alignment aid;

a filler material partially or entirely filling the interior cavity; and a hosel portion coupled to the hosel bore, the hosel portion comprising:

an insert portion received in the hosel bore;

a first bend portion;

a second bend portion; and a tip portion configured to receive a golf shaft, wherein the hosel bore and the hosel portion are disposed within a space bounded by a center longitudinal plane, a heel boundary plane, a front boundary plane, and a lateral plane parallel to the front boundary plane and separated from the front boundary plane by a distance equal to one third of a total length of the golf club head in a front-to-rear direction, wherein the hosel bore and the hosel portion are intersected by a heel dividing plane parallel to and equidistant from the center longitudinal plane and the heel boundary plane, and wherein the hosel portion is configured to orient a shaft axis toe-ward relative to a center of gravity (CG) of the golf club head.

2. A golf club head as defined in claim 1, wherein the shaft axis intersects the center longitudinal plane at or proximate to the alignment aid.

3. A golf club head as defined in claim 1, wherein the filler material comprises a polymer material.

4. A golf club head as defined in claim 1, wherein the body portion is defined by a forward portion and an aft portion, wherein the forward portion extends from a face portion at the front portion to a back wall portion located between the front portion and the rear portion, and wherein the aft portion extends rearward from the back wall portion and is cantilevered from the forward portion.

5. A golf club head as defined in claim 1, wherein the body portion further comprises a central void space located aft of the interior cavity.

6. A golf club head as defined in claim 1 further comprising a central portion coupled to the top portion and extending longitudinally in the front-to-rear direction, wherein the alignment aid is located on the central portion, and wherein the central portion is made from a material that is different from a material of the body portion.

7. A golf club head as defined in claim 1 further comprising a lower portion undergirding a bottom surface of the body portion, wherein the lower portion is made from a material that is different from a material of the body portion.

8. A golf club head comprising:

a body portion having toe portion, a heel portion, a front portion, a rear portion, a top portion, a sole portion, a hosel bore at the heel portion, and an interior cavity;

an alignment aid;

a filler material partially or entirely filling the interior cavity; and a hosel portion coupled to the hosel bore, the hosel portion comprising:

an insert portion received in the hosel bore;

a first bend portion;

a second bend portion; and a tip portion configured to receive a golf shaft, wherein the hosel bore and the hosel portion are disposed within a space bounded by a center longitudinal plane, a heel boundary plane, a front boundary plane, and a lateral plane parallel to the front boundary plane and separated from the front boundary plane by a distance equal to one third of a total length of the golf club head in a front-to-rear direction, wherein the hosel bore and the hosel portion are intersected by a heel dividing plane parallel to and equidistant from the center longitudinal plane and the heel boundary plane, wherein the hosel portion is configured to orient a shaft axis toe-ward relative to a center of gravity (CG) of the golf club head, and wherein the shaft axis intersects the center longitudinal plane at or proximate to the alignment aid.

9. A golf club head as defined in claim 8, wherein a distance between the shaft axis and a CG location in a heel-to-toe direction is greater than or equal to 5 mm and less than or equal to 6 mm.

10. A golf club head as defined in claim 8, wherein the filler material comprises a polymer material.

11. A golf club head as defined in claim 8, wherein the body portion is defined by a forward portion and an aft portion, wherein the forward portion extends from a face portion at the front portion to a back wall portion located between the front portion and the rear portion, and wherein the aft portion extends rearward from the back wall portion and is cantilevered from the forward portion.

12. A golf club head as defined in claim 8, wherein the body portion further comprises a central void space located aft of the interior cavity.

13. A golf club head as defined in claim 8 further comprising a central portion coupled to the top portion and extending longitudinally in the front-to-rear direction, wherein the alignment aid is located on the central portion, and wherein the central portion is made from a material that is different from a material of the body portion.

14. A golf club head as defined in claim 8 further comprising a lower portion undergirding a bottom surface of the body portion, wherein the lower portion is made from a material that is different from a material of the body portion.

15. A golf club head comprising:

a body portion having toe portion, a heel portion, a front portion, a rear portion, a top portion, a sole portion, a hosel bore at the heel portion, and an interior cavity;

an alignment aid;

a filler material partially or entirely filling the interior cavity; and a hosel portion coupled to the hosel bore, the hosel portion comprising:

an insert portion received in the hosel bore;

a first bend portion;

a second bend portion; and a tip portion configured to receive a golf shaft, wherein the hosel bore and the hosel portion are disposed within a space bounded by a center longitudinal plane, a heel boundary plane, a front boundary plane, and a lateral plane parallel to the front boundary plane and separated from the front boundary plane by a distance equal to one third of a total length of the golf club head in a front-to-rear direction, wherein the hosel bore and the hosel portion are intersected by a heel dividing plane parallel to and equidistant from the center longitudinal plane and the heel boundary plane, wherein the hosel portion is configured to orient a shaft axis toe-ward relative to a center of gravity (CG) of the golf club head, and wherein the filler material comprises a polymer material.

16. A golf club head as defined in claim 15, wherein the shaft axis intersects the center longitudinal plane at or proximate to the alignment aid.

17. A golf club head as defined in claim 15, wherein the body portion is defined by a forward portion and an aft portion, wherein the forward portion extends from a face portion at the front portion to a back wall portion located between the front portion and the rear portion, and wherein the aft portion extends rearward from the back wall portion and is cantilevered from the forward portion.

18. A golf club head as defined in claim 15, wherein the body portion further comprises a central void space located aft of the interior cavity.

19. A golf club head as defined in claim 15 further comprising a central portion coupled to the top portion and extending longitudinally in the front-to-rear direction, wherein the alignment aid is located on the central portion, and wherein the central portion is made from a material that is different from a material of the body portion.

20. A golf club head as defined in claim 15 further comprising a lower portion undergirding a bottom surface of the body portion, wherein the lower portion is made from a material that is different from a material of the body portion.

* * * * *